US012420150B2

(12) United States Patent
Greaney

(10) Patent No.: US 12,420,150 B2
(45) Date of Patent: Sep. 23, 2025

(54) GOLF CLUB HEAD WITH EMBEDDED TRACKING MARKERS

(71) Applicant: Taylor Made Golf Company, Inc., Carlsbad, CA (US)

(72) Inventor: Mark Greaney, Vista, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 17 days.

(21) Appl. No.: 18/313,186

(22) Filed: May 5, 2023

(65) Prior Publication Data

US 2023/0356039 A1 Nov. 9, 2023

Related U.S. Application Data

(60) Provisional application No. 63/338,818, filed on May 5, 2022.

(51) Int. Cl.

| | |
|---|---|
| ***A63B 53/04*** | (2015.01) |
| ***A63B 24/00*** | (2006.01) |
| ***A63B 69/36*** | (2006.01) |

(52) U.S. Cl.

CPC ..... *A63B 53/0445* (2020.08); *A63B 24/0003* (2013.01); *A63B 53/0408* (2020.08); *A63B 2024/0043* (2013.01); *A63B 2024/0056* (2013.01); *A63B 2209/02* (2013.01); *A63B 2209/10* (2013.01); *A63B 2220/833* (2013.01)

(58) Field of Classification Search

CPC ..... A63B 53/0445; A63B 69/3605; A63B 69/3614

See application file for complete search history.

(56) References Cited

U.S. PATENT DOCUMENTS

| | | | | | |
|---|---|---|---|---|---|
| 4,844,469 | A * | 7/1989 | Yasuda | A63B 69/3605 | 473/221 |
| 5,269,519 | A * | 12/1993 | Malone | A63F 13/245 | 473/154 |
| 5,575,719 | A * | 11/1996 | Gobush | A63B 24/0021 | 473/223 |
| 5,609,534 | A * | 3/1997 | Gebhardt | A63B 24/0003 | 473/409 |
| 6,520,864 | B1 * | 2/2003 | Wilk | A63B 57/00 | 473/407 |
| 7,497,780 | B2 * | 3/2009 | Kiraly | A63B 24/0021 | 463/42 |
| 8,012,039 | B2 | 9/2011 | Greaney et al. | | |
| 8,303,435 | B2 | 11/2012 | Chao | | |

(Continued)

FOREIGN PATENT DOCUMENTS

| | | | |
|---|---|---|---|
| CN | 103348382 A * | 10/2013 | A63B 37/0003 |
| GB | 2517712 | 3/2015 | |

OTHER PUBLICATIONS

U.S. Appl. No. 18/105,194, filed Feb. 2, 2023.

(Continued)

*Primary Examiner* — Alvin A Hunter

(74) *Attorney, Agent, or Firm* — Kunzler Bean & Adamson

(57) ABSTRACT

A golf club head comprises a forward portion, comprising a strike face, and at least one tracking marker, configured to be tracked by a launch monitor and permanently embedded in the forward portion. The at least one tracking marker comprises a retroreflective surface that is more retroreflective than the strike face.

65 Claims, 19 Drawing Sheets

(56) References Cited

U.S. PATENT DOCUMENTS

| | | | | |
|---|---|---|---|---|
| 8,512,160 | B2 * | 8/2013 | Gobush | A63B 24/0021 473/190 |
| 8,951,138 | B2 * | 2/2015 | Kiraly | A63B 69/3658 473/223 |
| 9,089,745 | B2 | 7/2015 | Greaney et al. | |
| 9,174,099 | B2 | 11/2015 | Greaney et al. | |
| 10,881,916 | B2 | 1/2021 | Greaney et al. | |
| 10,902,612 | B2 | 1/2021 | Tofolo et al. | |
| 11,596,841 | B2 | 3/2023 | Beach et al. | |
| 2002/0173367 | A1 * | 11/2002 | Gobush | A63B 69/3614 473/197 |
| 2003/0130054 | A1 * | 7/2003 | Bissonnette | A63B 24/0021 473/199 |
| 2005/0114073 | A1 * | 5/2005 | Gobush | A63B 71/0622 702/143 |
| 2005/0239575 | A1 * | 10/2005 | Chao | A63B 53/047 473/345 |
| 2007/0298897 | A1 * | 12/2007 | Kiraly | A63B 24/0021 473/131 |
| 2009/0005191 | A1 * | 1/2009 | Lin | A63B 53/0466 473/331 |
| 2011/0028248 | A1 * | 2/2011 | Ueda | A63B 69/3632 473/409 |
| 2012/0199282 | A1 | 8/2012 | Chao | |
| 2012/0214606 | A1 * | 8/2012 | Ueda | A63B 69/3614 473/409 |
| 2014/0274446 | A1 | 9/2014 | Greaney et al. | |
| 2019/0192944 | A1 * | 6/2019 | Hightower | A63B 24/0006 |
| 2021/0228945 | A1 | 7/2021 | Loper et al. | |
| 2022/0047923 | A1 | 2/2022 | Durham | |
| 2022/0150673 | A1 | 5/2022 | Lord et al. | |
| 2022/0184466 | A1 | 6/2022 | Greensmith et al. | |
| 2022/0184468 | A1 | 6/2022 | Greaney et al. | |
| 2022/0184470 | A1 | 6/2022 | Greensmith et al. | |
| 2022/0184746 | A1 | 6/2022 | Greaney et al. | |
| 2022/0363046 | A1 | 11/2022 | Greaney et al. | |
| 2023/0249036 | A1 | 8/2023 | Greaney et al. | |

OTHER PUBLICATIONS

Reflective Dot product for Foresight HMT or Quad accessed from https://www.amazon.com/Reflective-Dots-Foresight-Quad-1000/dp/B07Q7SNK2M on Feb. 15, 2024.

* cited by examiner

GOLF CLUB HEAD WITH EMBEDDED TRACKING MARKERS

CROSS-REFERENCE TO RELATED APPLICATION

This application claims the benefit of U.S. Provisional Patent Application No. 63/338,818, filed May 5, 2022, which is incorporated herein by reference in its entirety.

FIELD

This disclosure relates generally to golf clubs, and more particularly to golf club heads configured to promote detection and accuracy when analyzed by a launch monitor.

BACKGROUND

For some launch monitors, which detect head presentation parameters of a golf club head during a golf swing, tracking markers (or stickers) are manually and temporarily adhered to the face of a finished golf club head. Conventional tracking markers include a surface that is identified by the launch monitor and tracked during the golf swing to determine the head presentation parameters of the golf club head. To promote accuracy, the tracking markers should be positioned in precise locations corresponding to those expected by the launch monitor.

However, the conventional process of manually sticking conventional tracking markers on the face of a golf club head is imprecise. Additionally, manual placement of conventional tracking markers on a finished golf club head is time consuming and requires removal of adhesive residue, which can be left behind on the face of the golf club head after the conventional tracking markers are removed. Additionally, tracking markers are designed only for temporary use during a launch monitor hitting session. In fact, tracking markers on the outside surface of the strike face renders the golf club head non-conforming under current United States Golf Association (USGA) rules (e.g., Rule 4.1a(3) considers stickers on the outside of a golf club to be an external attachment, and thus rendering the golf club as non-confirming equipment). Players using a golf club head with temporary tracking markers on the outside of the strike face can and should be disqualified from tournaments and competitions. Accordingly, conventional tracking markers, which are designed only for temporary use, must be removed following a launch monitor hitting session and before the golf club head is in suitable condition for actual play. Although many players know this rule, the small size of the tracking markers can make it easy to accidentally leave the markers on the face as the players transition from a launch monitor session, such as on the range, to tournament play. Also, conventional tracking markers are manufactured, purchased, and stored separate from golf club heads, which adds to the cost and burden associated with determining presentation parameters of a golf club head by a launch monitor during a hitting session.

SUMMARY

The subject matter of the present application has been developed in response to the present state of the art, and in particular, in response to the shortcomings of golf club heads and tracking markers that have not yet been fully solved. Accordingly, the subject matter of the present application has been developed to provide a golf club head, with embedded tracking markers, that overcomes at least some of the above-discussed shortcomings of conventional golf club heads.

Disclosed herein is a golf club head. The golf club head comprises a forward portion, comprising a strike face, and at least one tracking marker, configured to be tracked by a launch monitor and permanently embedded in the forward portion. The at least one tracking marker comprises a retroreflective surface that is more retroreflective than the strike face. The preceding subject matter of this paragraph characterizes example 1 of the present disclosure.

The forward portion comprises an inner layer and an outer layer, the outer layer adjoining the inner layer and the outer layer defining the strike face. The at least one tracking marker is interposed between the outer layer and the inner layer. The at least one tracking marker is detectable by the launch monitor through the outer layer. The preceding subject matter of this paragraph characterizes example 2 of the present disclosure, wherein example 2 also includes the subject matter according to example 1, above.

The inner layer is made of a fiber reinforced polymeric material and the outer layer is made of a non-reinforced polymeric material. The preceding subject matter of this paragraph characterizes example 3 of the present disclosure, wherein example 3 also includes the subject matter according to example 2, above.

The outer layer comprises scorelines formed in the strike face. The at least one tracking marker is offset from any one of the scorelines in a direction parallel to the strike face. The preceding subject matter of this paragraph characterizes example 4 of the present disclosure, wherein example 4 also includes the subject matter according to any of examples 2-3, above.

A thickness of the outer layer between the strike face and the at least one tracking marker is greater than a thickness of the outer layer between any one of the scorelines and the inner layer. The preceding subject matter of this paragraph characterizes example 5 of the present disclosure, wherein example 5 also includes the subject matter according to example 4, above.

The strike face, between the scorelines, is textured. The preceding subject matter of this paragraph characterizes example 6 of the present disclosure, wherein example 6 also includes the subject matter according to any of examples 4-5, above.

A texture of the strike face adjacent to the at least one tracking marker is different than a texture of the strike face over the at least one tracking marker. The preceding subject matter of this paragraph characterizes example 7 of the present disclosure, wherein example 7 also includes the subject matter according to example 6, above.

Each one of the texture of the strike face adjacent to the at least one tracking marker and the texture of the strike face over the at least one tracking marker comprises a sawtooth pattern. The preceding subject matter of this paragraph characterizes example 8 of the present disclosure, wherein example 8 also includes the subject matter according to example 7, above.

The inner layer is made of a metallic material. The outer layer is made of a non-reinforced polymeric material. The preceding subject matter of this paragraph characterizes example 9 of the present disclosure, wherein example 9 also includes the subject matter according to any of examples 2-8, above.

The forward portion further comprises a recess formed in the strike face. The at least one marker is seated in the recess. The outer layer comprises a cover in the recess over the at least one marker. The preceding subject matter of this paragraph characterizes example 10 of the present disclosure, wherein example 10 also includes the subject matter according to example 9, above.

The retroreflective surface of the at least one tracking marker retroreflects light having a wavelength greater than 700 nanometers. The preceding subject matter of this paragraph characterizes example 11 of the present disclosure, wherein example 11 also includes the subject matter according to any of examples 2-10, above.

The at least one tracking marker comprises a sticker having an adhesive layer and a retroreflective layer. The retroreflective layer comprises a pattern of retroreflective elements each made of an at least partially transparent material. The preceding subject matter of this paragraph characterizes example 12 of the present disclosure, wherein example 12 also includes the subject matter according to any of examples 1-11, above.

The sticker further comprises a cover fixed to the retroreflective layer so that air gaps are defined between the cover and the retroreflective elements, and so that the retroreflective layer is interposed between the cover and the adhesive layer. The preceding subject matter of this paragraph characterizes example 13 of the present disclosure, wherein example 13 also includes the subject matter according to example 12, above.

The golf club head further comprises a plurality of tracking markers, each located at a corresponding one of an upper-toe position, a middle-toe position, a lower-toe position, and a middle-heel position of the strike face. The preceding subject matter of this paragraph characterizes example 14 of the present disclosure, wherein example 14 also includes the subject matter according to any of examples 1-13, above.

The golf club head further comprises a plurality of tracking markers permanently embedded in the forward portion at various locations relative to the strike face. The preceding subject matter of this paragraph characterizes example 15 of the present disclosure, wherein example 15 also includes the subject matter according to any of examples 1-14, above.

The plurality of the tracking markers have the same size and shape. The preceding subject matter of this paragraph characterizes example 16 of the present disclosure, wherein example 16 also includes the subject matter according to example 15, above.

At least one of the plurality of the tracking markers has a size that is different than the size of another one of the plurality of tracking markers. The preceding subject matter of this paragraph characterizes example 17 of the present disclosure, wherein example 17 also includes the subject matter according to example 15, above.

At least a first one of the plurality of tracking markers is embedded in the forward portion at a toe portion of the strike face. At least a second one of the plurality of tracking markers is embedded in the forward portion at a heel portion of the strike face. The size of the second one of the plurality of tracking markers is larger than the size of the first one of the plurality of tracking markers. The preceding subject matter of this paragraph characterizes example 18 of the present disclosure, wherein example 18 also includes the subject matter according to example 17, above.

At least one of the plurality of the tracking markers has a shape that is different than the shape of another one of the plurality of tracking markers. The preceding subject matter of this paragraph characterizes example 19 of the present disclosure, wherein example 19 also includes the subject matter according to any of examples 15, 17, or 18, above.

At least first ones of the plurality of tracking markers is embedded in the forward portion at a toe portion of the strike face. At least a second one of the plurality of tracking markers is embedded in the forward portion at a heel portion of the strike face. The shape of the second one of the plurality of tracking markers is different than the shape of the first ones of the plurality of tracking markers. The preceding subject matter of this paragraph characterizes example 20 of the present disclosure, wherein example 20 also includes the subject matter according to example 19, above.

The at least one tracking marker has a circular shape on a plane passing through the at least one tracking marker and parallel to a loft plane of the golf club head. The preceding subject matter of this paragraph characterizes example 21 of the present disclosure, wherein example 21 also includes the subject matter according to any of examples 1-20, above.

The at least one tracking marker has a non-circular shape on a plane passing through the at least one tracking marker and parallel to a loft plane of the golf club head. The preceding subject matter of this paragraph characterizes example 22 of the present disclosure, wherein example 22 also includes the subject matter according to any of examples 1-21, above.

The golf club head further comprises a body. The body comprises the forward portion and further comprises a toe portion, a heel portion, a crown portion, and a sole portion. The golf club head further comprises at least one second tracking marker. The at least second tracking marker is configured to be tracked by the launch monitor, is permanently embedded in one of the toe portion, the heel portion, the crown portion, or the sole portion at a location away from the strike face, and comprises a retroreflective surface that is more retroreflective than the one of the toe portion, the heel portion, the crown portion, or the sole portion. The preceding subject matter of this paragraph characterizes example 23 of the present disclosure, wherein example 23 also includes the subject matter according to any of examples 1-22, above.

The forward portion comprises a strike plate. The strike plate comprises a plurality of composite prepreg plies, and a polymeric cover that defines the strike face and is adjoined to the plurality of composite prepreg plies. The polymeric cover has a thickness between, and inclusive of, 0.1 mm and 3.0 mm. The preceding subject matter of this paragraph characterizes example 24 of the present disclosure, wherein example 24 also includes the subject matter according to any of examples 1-23, above.

The polymeric cover comprises a plurality of surface features configured so that a mean roughness of the strike face is between, and inclusive of, 2.5 micrometers and 5 micrometers. The thickness of the polymeric cover is between, and inclusive of, 0.2 mm and 1.2 mm. The preceding subject matter of this paragraph characterizes example 25 of the present disclosure, wherein example 25 also includes the subject matter according to example 24, above.

The preceding subject matter of this paragraph characterizes example 26 of the present disclosure, wherein example 26 also includes the subject matter according to example 25, above.

Further disclosed herein is a system for detecting head presentation parameters of a golf club head. The system comprises a golf club comprising a golf club head. The golf club head comprises a forward portion, comprising a strike face, and at least one tracking marker permanently embedded in the forward portion. The at least one tracking marker comprises a retroreflective surface that is more retroreflective than the strike face. The system also comprises a launch monitor that is selectively operable to transmit light to the retroreflective surface of the at least one tracking marker and to detect light reflected from the retroreflective surface during a golf swing of the golf club. The system further comprises a display configured to generate a visual representation of head presentation data based on the light detected by the launch monitor. The preceding subject matter of this paragraph characterizes example 27 of the present disclosure.

The display is physically proximate the launch monitor. The preceding subject matter of this paragraph characterizes example 28 of the present disclosure, wherein example 28 also includes the subject matter according to example 27, above.

The display is physically remote from the launch monitor. The preceding subject matter of this paragraph characterizes example 29 of the present disclosure, wherein example 29 also includes the subject matter according to example 27, above.

The launch monitor is an optical-based launch monitor. The preceding subject matter of this paragraph characterizes example 30 of the present disclosure, wherein example 30 also includes the subject matter according to any of examples 23-29, above.

Additionally disclosed herein is a golf club head that comprises a forward portion, comprising an inner layer and an outer layer adjoining the inner layer. The outer layer defines a strike face. The golf club head also comprises at least one tracking marker permanently interposed between the outer layer and the inner layer. An entirety of the tracking marker is covered by the outer layer. The at least one tracking marker comprises a retroreflective surface that is more retroreflective than the strike face, is configured to be tracked by a launch monitor, and is configured to retroreflect infrared light having a wavelength between, and inclusive, of 725 nanometers (nm) and 1,250 nm. The preceding subject matter of this paragraph characterizes example 31 of the present disclosure.

The golf club head comprises four tracking markers permanently interposed between the outer layer and the inner layer of the forward portion. The preceding subject matter of this paragraph characterizes example 32 of the present disclosure, wherein example 32 also includes the subject matter according to example 31, above.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other examples, additional features and advantages may be recognized in certain examples and/or implementations that may not be present in all examples or implementations. Further, in some examples, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Disclosed herein is a golf club head, and associated methods of manufacture, that provides a cost-effective, time-saving, accurate, and clean way to detect head presentation parameters of the golf club head during a hitting session. The golf club head of the present disclosure can be any of various types of golf club heads, such as a driver golf club head, a fairway metal or hybrid golf club head, an iron golf club head, and a putter golf club head. Accordingly, the benefit of the present disclosure is applicable across multiple types of golf club heads.

Figure 1:
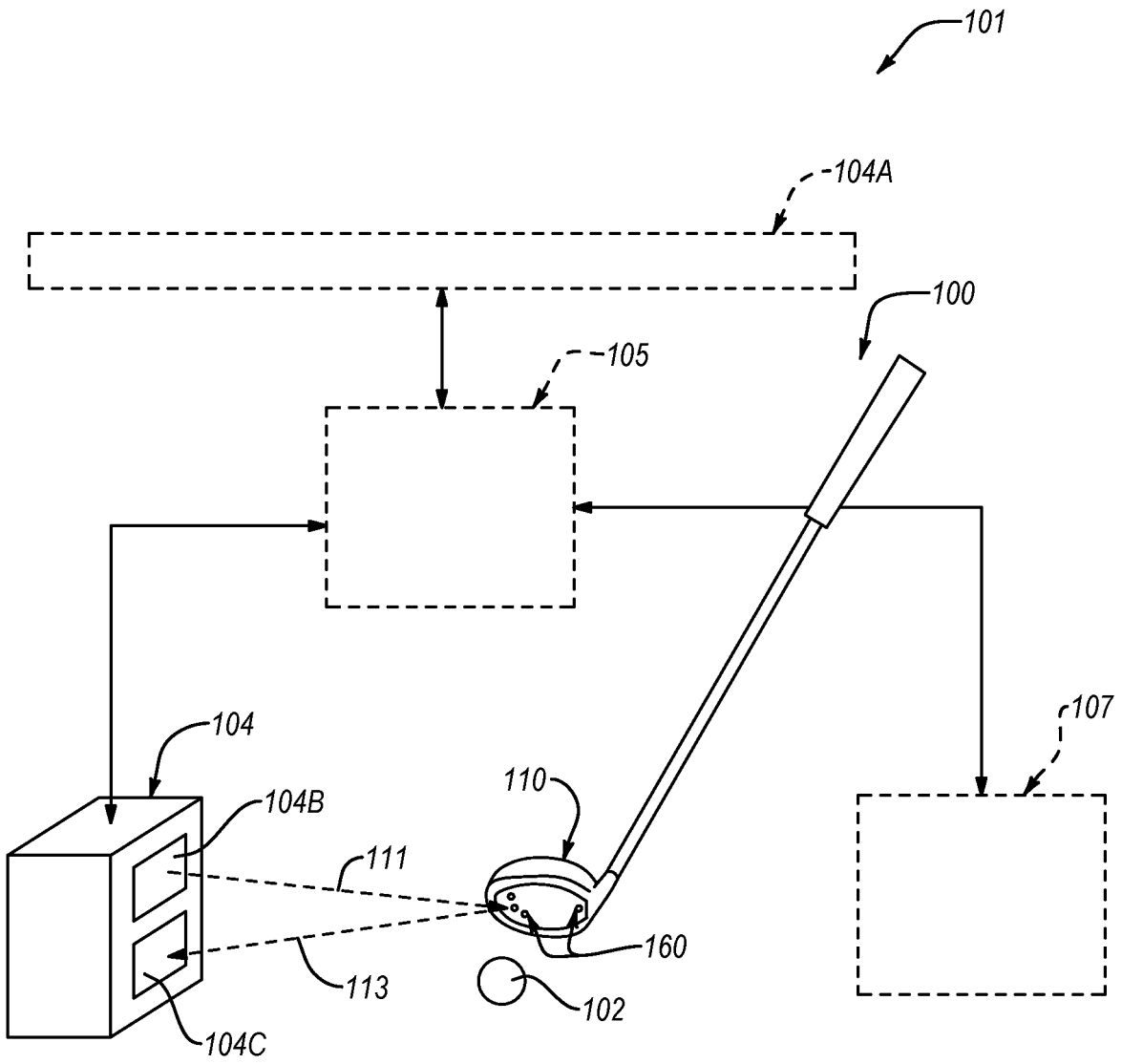
FIG. 1 is a schematic block diagram of a system for detecting head presentation parameters of a golf club head during a golf swing, according to one or more examples of the present disclosure.

Referring to FIG. 1, a system 101 includes a launch monitor 104, which is shown detecting the head presentation parameters of the golf club head 110 of a golf club 100 during a hitting session. The launch monitor 104 includes an emitter 104B and a receiver 104C. The emitter 104B is operable to generate incident light 111 (e.g., infrared light, radar waves, visible light, etc.) directed toward the golf club head 110. The receiver 104C is operable to receive and detect retroreflected light 113, which includes a portion of the incident light 111 that is retroreflected back to the receiver 104C from the golf club head 110. The receiver 104C can be any of various sensors, such as infrared cameras, radar sensors, visible light cameras, etc., that are specifically configured to detect light having wavelengths within a specified spectrum. In some examples, the receiver 104C is configured to detect only the retroreflected light 113 with wavelengths within specific spectrum (i.e., light with wavelengths outside of the specific spectrum are not detectable by the receiver 104C).

The golf club head 110 includes multiple tracking markers 160 embedded (e.g., permanently formed) in the golf club head 110. As the golf club head 110 makes impact with a golf ball 102, the launch monitor 104 detects the position of the golf club head 110 and the golf ball 102 through a hitting zone.

In some examples, the launch monitor 104 is an optical-based launch monitor (e.g., a photometric launch monitor) that is configured to detect the position of the golf club head 110 and the golf ball 102 using light in the infrared spectrum (e.g., electromagnetic radiation having wavelengths between, and inclusive of, 700 nanometers (nm) and 10,000 nm, more preferably having wavelengths between, and inclusive of, 750 nm and 1,250 nm, and even more preferably between, and inclusive of, 800 nm and 1,150 nm). The optical-based launch monitor includes sensors that capture digital images of infrared light. One example of an optical-based launch monitor is the GCQuad™ launch monitor, made by Foresight Sports™. Accordingly, as used herein, the term optical refers to infrared light and does not refer to visible light.

In some examples, the launch monitor 104 is a radar-based launch monitor that is configured to detect the position of the golf club head 110 and the golf ball 102 using light in the radio wave spectrum (e.g., electromagnetic radiation having wavelengths between, and inclusive of, 10 cm and 100 km). The radar-based launch monitor includes sensors that capture digital images (e.g., data) that identify radio waves (i.e., doppler radar). One example of a radar-based launch monitor is the Mevo+™ launch monitor, made by FlightScope™.

In yet other examples, the launch monitor 104 is configured to detect the position of the golf club head 110 and the golf ball 102 using light in the visible light spectrum (e.g., electromagnetic radiation between, and inclusive of, 400 nm and 700 nm). Visible-light launch monitors include conventional camera sensors that capture digital images of visible light. According to other examples, the launch monitor 104 is configured to detect the position of the golf club head 110 and the golf ball 102 using light in the ultraviolet light spectrum (e.g., electromagnetic radiation between, and inclusive of, 10 nm and 400 nm). Although light is conventionally considered to be limited to visible light, as used here, light can mean any electromagnetic radiation having wavelengths within any range along the electromagnetic spectrum (including non-visible light and what are conventionally considered sound waves) unless otherwise indicated.

The tracking markers 160 are more retroreflective than other portions of the golf club head 110. Accordingly, the identification of the position of the tracking markers 160 in the digital images is made easier by the increased retroreflectively of light off of the tracking markers 160 relative to other portions of the golf club head 110. The tracking markers 160 are sized and shaped to cover only discrete portions of the golf club head 110, the positions of which correspond to one or more head presentation parameters of the golf club head 110. The launch monitor 104 is preprogrammed to associate the position of the tracking markers 160 in the digital images to the discrete portions of the golf club head 110. Accordingly, for accurate results, the tracking markers 160 should be accurately positioned at the discrete portions of the golf club head 110. Because the tracking markers 160 are embedded (e.g., permanently formed) in the golf club head 110, the golf club head 110 with the tracking markers 160 are USGA conforming, and the accuracy and precision of the position of the tracking markers 160 at the discrete portions of the golf club head 110 can be more easily achieved during the manufacturing of the golf club head 110 than during a manual post-manufacturing process by a user of the golf club head 110. For example, robots are often used to help manufacture golf club heads and can be used to automatedly apply the tracking markers 160 at the discrete portions of the golf club head 110. Examples of launch monitors, and methods of using launch monitors to effectively capture head presentation parameters of a golf club head can be found in U.S. Pat. No. 8,951,138, issued Feb. 10, 2015, which is incorporated herein in its entirety.

In certain examples, in addition or as an alternative to the launch monitor 104, the system 101 includes an overhead launch monitor 104A. The overhead launch monitor 104A can be a launch monitor, similar to the launch monitor 104, but has a broader range of detectability than the launch monitor 104. According to some examples, the launch monitor 104 is located on the ground (e.g., at a driving range, simulator, or otherwise) within a predetermined distance (e.g., 2-3 feet) from the golf ball 102 and the golf club head 110 at address. In some situations, such as during actual play on a golf course, locating a ground-based launch monitor, such as the launch monitor 104, may be impractical. Because the overhead launch monitor 104A has a broader range of detectability, utilizing the overhead launch monitor 104A during actual play on a golf course may be more practical than a ground-based launch monitor. For example, an overhead launch monitor 104A can be situated above a tee box for one or more holes of a golf course being played in a golf tournament. The overhead launch monitor 104A is configured to detect the head presentation parameters of the golf club head 110 regardless of where the golf ball 102 is located on the tee box. In certain examples, an entirety of the tee box can be within an area detectable by one or more launch monitors (e.g., by positioning the overhead launch monitor 104A on the ground or on its side, or by using an array of launch monitors 104 on the ground, with each one of the launch monitors 104 having a different focal length).

Whether the launch monitor used is one or both of the launch monitor 104 and the overhead launch monitor 104A, in some examples, the head presentation parameters of the golf club head 110, sensed by the launch monitor during a golf swing, are transmitted to an electronic controller 105 of the system 101. Transmission of the sensed parameters can be wired or wireless and facilitated by any of various hardware, such as wireless transceivers, and the like. The electronic controller 105 includes a processor, memory, and code stored on the memory which is executable by the processor to process the sensed head presentation parameters received from the launch monitor(s) and output corresponding head presentation data. The output data from the electronic controller 105 can be fed to a display 107 of the system 101 in certain examples. The display 107 is configured to visually display and/or or auditorily represent the output data.

In some examples, the display 107 is physically proximate or physically associated with the swinger of the golf club 100 (e.g., golfer) being sensed by the launch monitor, or, put another way, physically proximate or physically associated with the launch monitor 104. For example, the display 107 can be a user's mobile device, a tablet, a laptop, a wearable device, a display associated with the user's golf equipment (e.g., a display on the golf club 100, a display on the golfer's bag, a display on the golfer's head cover, etc., such as disclosed in U.S. patent application Ser. No. 18/105,194, filed Feb. 2, 2023, U.S. patent application Ser. No. 17/438,501, filed Sep. 13, 2021, and UK Patent Application No. GB2517712, filed Aug. 28, 2013, which are incorporated herein by reference in their entirety). In one example, the display 107 is a public display at a driving range where the golfer is swinging the golf club 100. According to another example, the display 107 is a virtual display associated with electronic or virtual gaming devices or platforms. The display 107 can be incorporated into glasses, worn by the swinger of the golf club 100 or spectator, such as the glasses described in U.S. Provisional Patent Application No. 63/436,326, filed Dec. 30, 2022, which is incorporated herein by reference in its entirety.

However, in other examples, the display 107 is not physically proximate or not physically associated with the golfer or the optical-based launch monitor 104 (e.g., is physically remote from the golfer and the launch monitor 104). For example, the display 107 can be associated with a spectator or spectators at a golf course, broadcasters of a golf tournament, remote viewers of a golf tournament, webcasters of information associated with a golf tournament, and the like. In one example, a remote viewer of a golf tournament can receive head presentation data for a golfer's swing on a personal device of the remote viewer.

Referring to FIGS. 2-7, examples of a golf club head 210 are shown. The golf club head 210 is a driver golf club head. The golf club head 210 includes a body 220 having a heel portion 222, a toe portion 224, a crown portion 226, a sole portion 228, and a forward portion 230. The golf club head 210 also includes a rearward portion 229, opposite the forward portion 230 (see, e.g., FIGS. 16-18). Additionally, the golf club head 210 includes a skirt portion that defines a transition region where the golf club head 210 transitions between the crown portion 226 and the sole portion 228. Accordingly, the skirt portion is located between the crown portion 226 and the sole portion 228, and extends about a periphery of the golf club head 210. The golf club head 210 has a volume, equal to the volumetric displacement of the golf club head 210, that is between 390 cubic centimeters ($cm^3$ or cc) and about 600 $cm^3$. In more particular examples, the volume of the golf club head 210 is between about 350 $cm^3$ and about 500 $cm^3$ or between about 420 $cm^3$ and about 500 $cm^3$. The total mass of the golf club head 210 is between about 145 g and about 245 g, in some examples, and between 185 g and 210 g in other examples. A peak crown height typically ranges between 60 mm and 70 mm, preferably between 62 mm and 67 mm. The peak crown height is the maximum crown height of a golf club head where the crown height at a given location along the golf club head is the distance from a ground plane, parallel to the z-axis of a club head origin coordinate system, when the golf club head is in the address position on the ground plane, to an uppermost point on the crown portion at the given location. Positioning the golf club head 210 in the address or reference position lends itself to using a club head origin coordinate system, centered at a geometric center (e.g., center face) of the strike face 245, and defining an origin x-axis, an origin y-axis, and an origin z-axis for making various measurements, including defining coordinate locations of a center of gravity (CG) of the golf club head 210 relative to the origin coordinate system via a CGx coordinate, a CGy coordinate, and a CGz coordinate. With the golf club head in the address or reference position, using the USGA methodology, various parameters described throughout this application including head height, club head center of gravity (CG) location, and moments of inertia (MOI), can be measured relative to the club head origin coordinate system or relative to another reference or references, such as the center of gravity (CG) of the golf club head 210 and/or the ground plane. For example, a Z-up value for the golf club head 210 is the vertical distance along a z-axis from the ground plane to the CG of the golf club head 210. In some examples, the Z-up value of the golf club head 210 is between 22 and 39 mm, such as between 25 mm and 30 mm. It is desirable for the peak crown height to be two times (2×) larger than a Z-up value for the golf club head 210.

The heel portion 222 defines a hosel 232 of the golf club head 210. The toe portion 224 is opposite the heel portion 222, and the crown portion 226 is opposite the sole portion 228. The crown portion 226 and the sole portion 228 extend from the heel portion 222 to the toe portion 224. The toe portion 224 includes a toe of the golf club head 210, which is defined as at least a leftmost (e.g., toewardmost) point of the golf club head 210 as viewed in FIGS. 2-5. Similarly, the heel portion 222 includes a heel of the golf club head 210, which is defined as at least a rightmost (e.g., heelwardmost) point of the golf club head 210 as viewed in FIGS. 2-5. The sole portion 228 is at a bottom region of the golf club head 210, and the crown portion 226 is at a top region of the golf club head 210. The sole portion 228 includes a sole of the golf club head 210, which is defined as at least a bottommost point of the golf club head 210. The crown portion 226 includes a crown of the golf club head 210, which is defined as at least a topmost point of the golf club head 210. According to certain examples, a maximum distance from a leading edge to a trailing edge of the club head as measured parallel to the y-axis of the golf club head origin coordinate system is preferably between 112 mm and 127 mm, preferably between 115 mm and 127 mm, even more preferably between 119 mm and 127 mm. In some examples, the hosel 232 facilitates the inclusion of a flight control technology (FCT) system between the hosel 232 and the shaft to control the positioning of the golf club head 210 relative to the shaft. The FCT system may include a fastener that is accessible through a lower opening. The FCT system includes multiple movable parts that fit within, and extend from, the hosel 232. The fastener facilitates adjustability of the FCT system system by loosening the fastener and maintaining an adjustable position of the golf club head relative to the shaft by tightening the fastener. In some example, an assembly mass of the golf club head 210 ranges from 190 grams to 210 grams, preferably between 195 grams and 205 grams, preferably between 200 grams and 202 grams, and in some cases less than 203 grams. The golf club head mass includes the mass of any FCT system and fastener to tighten the FCT system, but not the shaft of a golf club of which the golf club head 210 forms a part or the grip of the golf club.

The forward portion 230 defines a strike face 245 that extends upward along the forward portion 230 from the sole portion 228 to the crown portion 226, and heelwardly from the toe portion 224 to the heel portion 222. As further defined, the strike face 245 faces in a generally forward direction. The strike face 245 can be co-formed with one or more other portions of the body 220 of the golf club head 210. However, in certain examples, the strike face 245 is formed separately from any other portion of the body 220. In examples where the strike face 245 is formed separately, the strike face 245 is defined by a strike plate 243 that is attached to the forward portion 230 of the body 220 over an opening formed in the forward portion 230 of the body 220. Moreover, in some examples, the golf club head 210 has a relatively high Izz, or moment of inertia about a vertical axis (i.e., a CG z-axis passing through the CG and parallel with the z-axis of the club head origin coordinate system). In some examples, Izz is greater than 450 kg-$mm^2$ and preferably Izz is greater than 480 kg-$mm^2$, and more preferably Izz is greater than 510 kg-$mm^2$, but less than 590 kg-$mm^2$ in certain implementations. According to some examples, the golf club head 210 has a relatively high Ixx, or moment of inertia about a horizontal axis (e.g., a CG x-axis passing through the CG and parallel with the x-axis of the club head origin coordinate system). In some examples, Ixx is greater than 300 kg-$mm^2$ or 320 kg-$mm^2$, and more preferably Ixx is greater than 320 kg-$mm^2$, more preferably Ixx is greater than 350 kg-$mm^2$, or 360 kg-$mm^2$. According to various examples of the golf club head 210, a ratio of Ixx/Izz is greater than 0.70. According to certain examples, a summation of Ixx and Izz is greater than 780 kg-$mm^2$, 800 kg-$mm^2$, 820 kg-$mm^2$, 825 kg-$mm^2$, 850 kg-$mm^2$, 860 kg-$mm^2$, 875 kg-$mm^2$, 900 kg-$mm^2$, 925 kg-$mm^2$, 950 kg-$mm^2$, 975 kg-$mm^2$, or 1000 kg-$mm^2$, but less than 1,100 kg-$mm^2$. For example, the summation of Ixx and Izz can be between 780 kg-$mm^2$ and 1,000 kg-$mm^2$, such as greater than 820 kg-$mm^2$ or greater than 870 kg-$mm^2$. Ixx is at least 65% of Izz in some examples, even more preferably Ixx is at least 68% of Izz in some examples. More details about inertia Izz and Ixx can be found in U.S. Patent Application Publication No. 2020/0139208, Published May 7, 2020, which is incorporated herein by reference in its entirety. The delta-1 of the golf club head 210 is a distance, along the y-axis of the head center face origin coordinate system, between the CG of the golf club head 210 and a shaft plane, in which lies a hosel axis of the hosel 232. The shaft plane is a substantially vertical plane, parallel to the x-axis of the head center face origin coordinate system and perpendicular to the ground plane, when the golf club head 210 is in the proper address position on the ground plane. The delta-1 can be more than 32 mm in some examples, but in other more preferable examples, the delta-1 is no more than 32 mm, such as from 13 mm to 36 mm, from 15 mm to 27 mm, from 18 mm to 22 mm, from 22 mm to 26 mm, or from 24 mm to 26 mm, in other examples. In certain examples, the Ixx of the golf club head is at least 335 kg·mm$^2$ and the delta-1 is no more than 32 mm, the Ixx of the golf club head is at least 345 kg·mm$^2$ and the delta-1 is no more than 32 mm, the Ixx of the golf club head is at least 355 kg·mm$^2$ and the delta-1 is no more than 32 mm, the Ixx of the golf club head is at least 365 kg·mm$^2$ and the delta-1 is no more than 32 mm, or the Ixx of the golf club head is at least 375 kg·mm$^2$ and the delta-1 is no more than 32 mm. In certain examples, the Ixx of the golf club head 210 is at least 335 kg·mm$^2$ and the delta-1 is between 22 mm and 32 mm, the Ixx of the golf club head 210 is at least 345 kg·mm$^2$ and the delta-1 is between 22 mm and 32 mm, the Ixx of the golf club head 210 is at least 355 kg·mm$^2$ and the delta-1 is between 22 mm and 32 mm, the Ixx of the golf club head 210 is at least 365 kg·mm$^2$ and the delta-1 is between 22 mm and 32 mm, the Ixx of the golf club head 210 is at least 375 kg·mm$^2$ and the delta-1 is between 23 mm and 32 mm, the Ixx of the golf club head 210 is at least 385 kg·mm$^2$ and the delta-1 is between 24 mm and 32 mm, the Ixx of the golf club head 210 is at least 395 kg·mm$^2$ and the delta-1 is between 25 mm and 32 mm, or the Ixx of the golf club head 210 is at least 405 kg·mm$^2$ and the delta-1 is between 27 mm and 32 mm.

Figure 6:
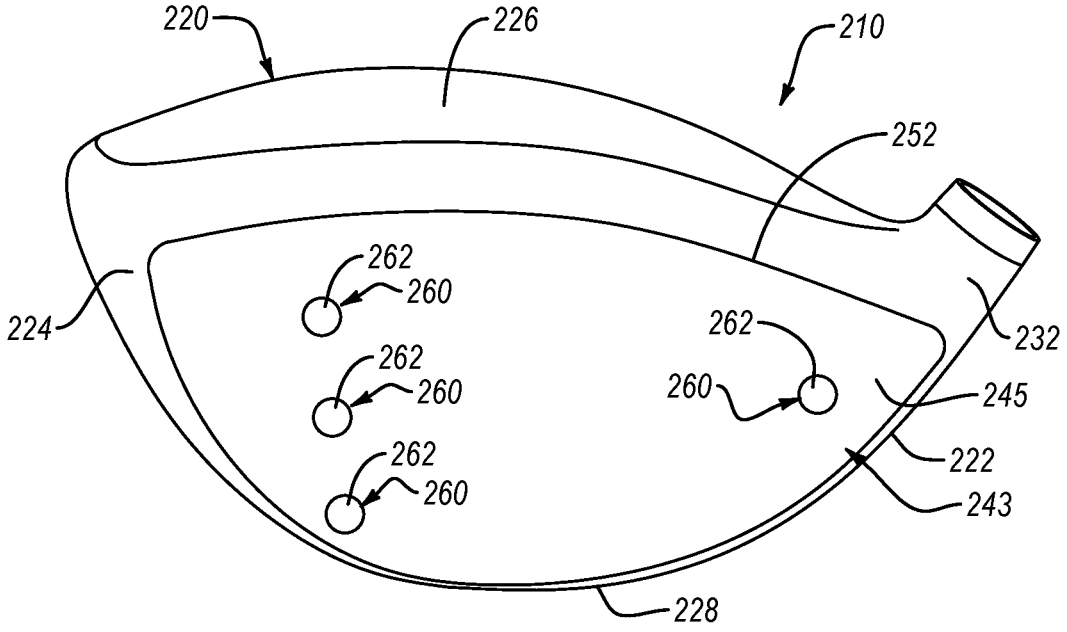
FIG. 6 is a schematic, perspective view of a golf club head, according to one or more examples of the present disclosure.
Figure 7:
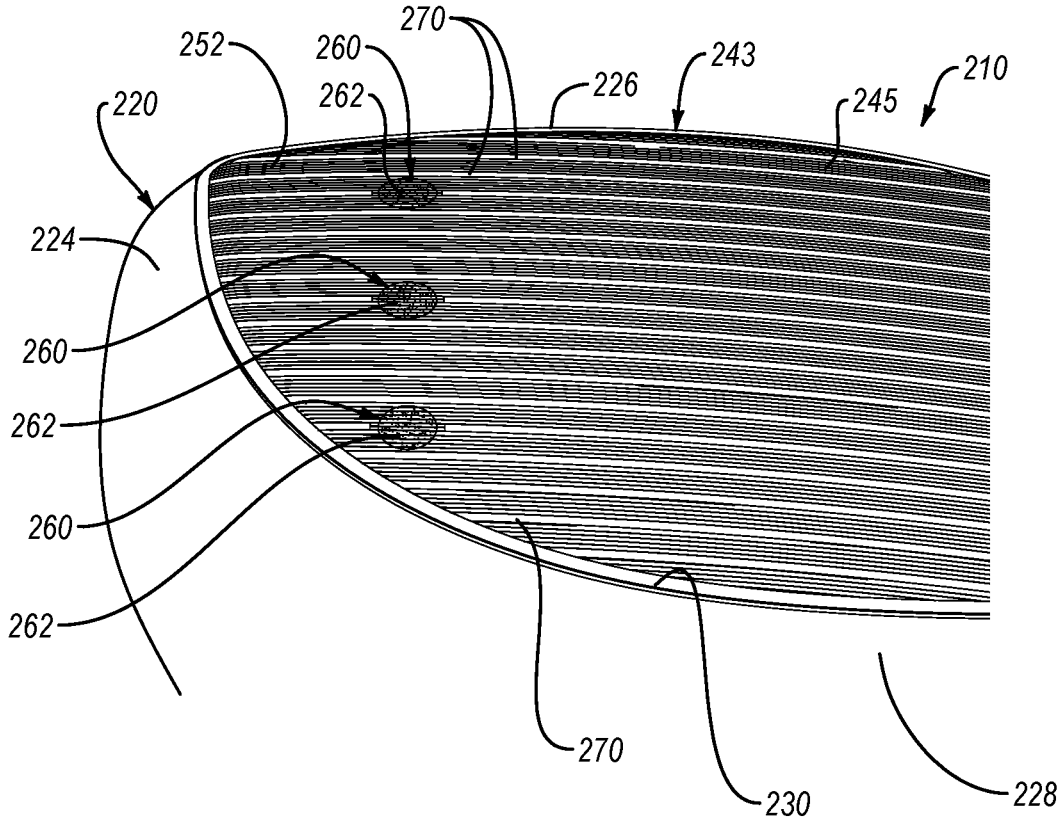
FIG. 7 is a schematic, perspective view of a golf club head, according to one or more examples of the present disclosure.
Figure 8:
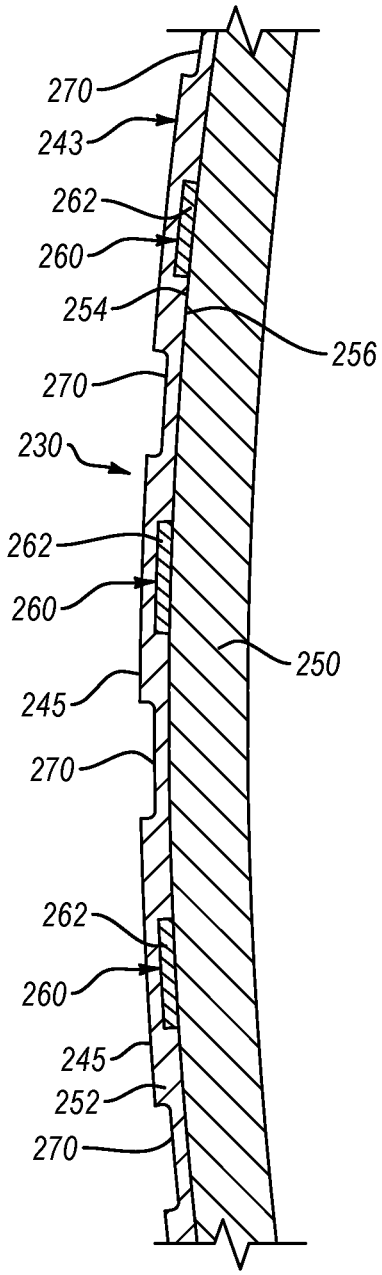
FIG. 8 is a schematic, cross-sectional, side elevation view of a golf club head, taken along the line A-A of FIG. 3A, according to one or more examples of the present disclosure.

Whether co-formed with other portions of the body 220 or formed separately as a strike plate and attached to the forward portion 230, in certain examples, the strike face 245 is made of a metallic material, such as a steel alloy or a titanium alloy. However, in other examples, the strike plate 243 is made of, at least partially, a fiber-reinforced polymeric material (FRPM) and a polymeric layer applied onto the fiber-reinforced polymeric material. In certain examples, the polymeric layer defines the strike face 245 and does not have reinforcing fibers. However, in other examples, the polymeric layer can include some fibers, such as glass fibers. For example, as shown in FIGS. 6-8, the strike plate 243 includes an FRPM layer 250 and a polymeric layer 252 affixed to the FRPM layer 250. More specifically, the FRPM layer 250 defines an outward facing surface 254, and the polymeric layer 252 includes an inward facing surface 256 that is affixed to the outward facing surface 254 of the FRPM layer 250. An outward facing surface 258 of the polymeric layer 252 defines the strike face 245 that impacts a golf ball during a golf swing. In some examples, the polymeric layer 252 is made of a non-reinforced polymeric material and includes a UV inhibitor, is abrasion resistant, and has a shore D value of between, and inclusive of, 40 and 100. In yet alternative examples, the strike face 245 is made of a thermoplastic polyester material.

Examples of golf club heads, and methods of manufacturing such golf club heads, that includes a strike plate comprising a FRPM layer and a polymeric layer can be found in U.S. patent application Ser. No. 18/172,834, filed Feb. 22, 2023, U.S. patent application Ser. No. 17/560,054, filed Dec. 22, 2021 (now U.S. Patent Application Publication No. 2022/0184468, published Jun. 16, 2022), U.S. patent application Ser. No. 17/228,511, filed Apr. 12, 2021, U.S. Provisional Patent Application No. 63/410,149, filed Sep. 26, 2022, U.S. Provisional Patent Application No. 63/345,875, filed May 25, 2022, U.S. patent application Ser. No. 17/124,134, filed Dec. 16, 2020, U.S. patent application Ser. No. 17/321,315, filed May 14, 2021, U.S. Patent Application No. 63/312,771, filed Feb. 22, 2022, U.S. patent application Ser. No. 17/389,167, filed Jul. 29, 2021, and U.S. Pat. No. 9,174,099, issued Nov. 3, 2015, U.S. Patent Application Publication No. 2012/0199282, published Aug. 9, 2012, U.S. Patent Application Publication No. 2014/0274446, published Sep. 18, 2014, which are all incorporated herein by reference in their entirety.

Additionally, Of alternatively, the club head may include indicia of alignment aids or additional color contrasts or images that are printed on one or more surfaces (not necessarily the outermost surface) of the golf club head (e.g. strike face and/or crown) and viewable to a user or a machine and the indicia may be printed using inkjet printing, single pass inkjet printing, digital printing, or other techniques, which are described more fully in U.S. patent application Ser. No. 17/156,205, filed on Jan. 22, 2021, U.S. Patent Application No. 62/965,129, filed on Jan. 23, 2020, U.S. Patent Application No. 63/066,033, filed on Aug. 14, 2020, and U.S. patent application Ser. No. 17/399,823, filed Aug. 11, 2021, which are incorporated herein by reference in their entirety.

The strike face may include bulge and roll radius feature, which can be incorporated into the strike plate, and can be similar to the bulge and roll radius features disclosed in U.S. Pat. No. 8,012,039, issued Sep. 6, 2011, which is incorporated herein by reference in its entirety.

The strike face may include twisted strike face features, which can be incorporated into the strike plate 243, can be similar to the features of the strike face disclosed in U.S. Pat. No. 10,881,916, issued Jan. 5, 2021, which is incorporated herein by reference in its entirety.

A plasma treatment process can be used and can be similar to or the same as the process described in U.S. Pat. No. 9,089,745, issued Jul. 28, 2015, which is incorporated herein by reference in its entirety.

Laser ablation can be applied to one or more bonding surfaces of the golf club head and can be accomplished in a manner described in U.S. patent application Ser. No. 17/389,167, filed Jul. 29, 2021, which is incorporated herein in its entirety. In some examples, the golf club head includes at least one of a crown insert, a sole insert, a rear ring and a continuous collar, similar to that shown and described in U.S. patent application Ser. No. 17/560,054, filed Dec. 22, 2021, which is incorporated herein by reference in its entirety. The composite face disclosed herein can be manufactured using alternative of additional manufacturing steps or have alternative or additional features, such as those disclosed in one or more of U.S. Pat. No. 8,303,435, issued Nov. 6, 2012, U.S. Pat. No. 8,684,864, issued Apr. 1, 2014, U.S. Pat. No. 9,089,745, issued Jul. 28, 2015, and U.S. Patent Application Publication No. 2014/0274446, published Sep. 18, 2014, which are all incorporated herein by reference in their entirety.

The forward portion 230 of the golf club head 210 also includes at least one tracking marker 260 or fiducial. The tracking marker 260 or fiducial is formed in or under the strike face 245, and is detectable by a launch monitor, such as an optical-based launch monitor, a radar-based launch monitor, or other type of launch monitor. Moreover, the tracking marker 260 is located in a location, corresponding to a location on the strike face 245, that is associated with an anticipated location pre-programed into the launch monitor. Because the tracking marker 260 is formed in or under the strike face 245, the golf club head 210 is USGA conforming.

Figure 2:
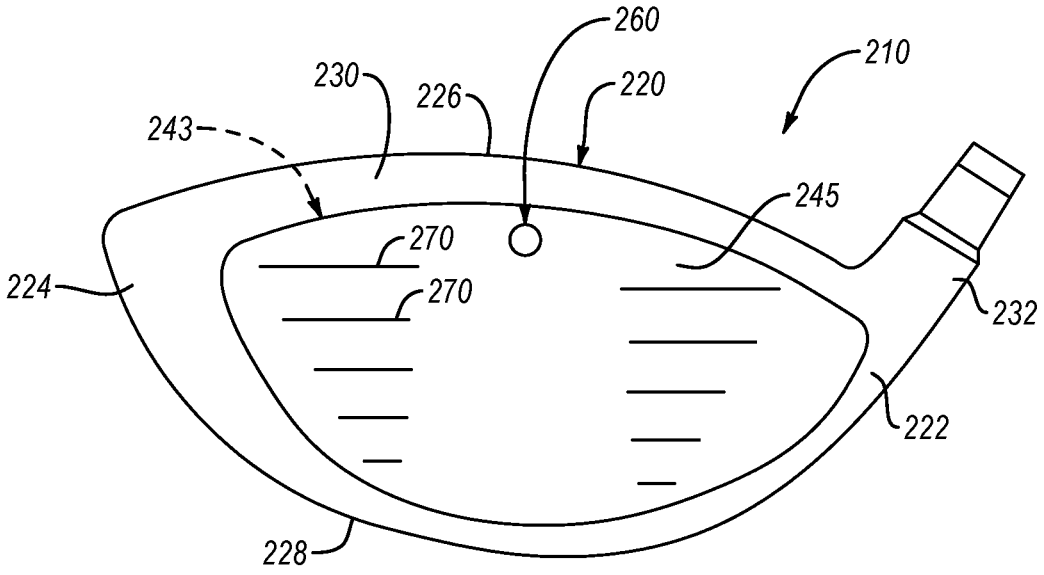
FIG. 2 is a schematic, front elevation view of a golf club head, according to one or more examples of the present disclosure.

In the example of FIG. 2, the golf club head 210 includes a single tracking marker 260 that is located at an upper-central portion of the strike face 245. In this location, the optical-based launch monitor is capable of detecting the tracking marker 260 and determining a first set of head presentation parameters (e.g., head speed). It is recognized that the optical-based launch monitor can be pre-programmed to recognize and anticipate tracking markers at any of various customizable locations on the golf club head 210. In other words, the tracking marker locations on a master golf club head are pre-programmed into the optical-based launch monitor (e.g., the electronic controller 105) to track golf club heads having tracking markers at locations corresponding with the master golf club head. In some examples, the tracking marker locations on the master golf club head can be any of various locations, whether visible or not visible to the golfer at address, as long as those locations enable the optical-based launch monitor to determine (e.g., triangulate) the location of center face and calculate desired head presentation parameters.

Additionally, in some examples, the geometry of the golf club head 210 can be known by the electronic controller 105, such as by uploading computer-aided drafting (CAD) model parameters to the electronic controller 105. By knowing the geometry of the golf club head 210, and knowing a location of one or more tracking markers 260 relative to the geometry, the electronic controller 105 can determine head presentation parameters of the golf club head 210 with fewer tracking markers 260 that wouldn't be determinable without knowing the geometry of the golf club head 210. In certain examples, the tracking markers 260 can be arranged in a unique pattern, or be located in unique locations, associated only with a particular golf club head (e.g., a particular brand of golf club head, or model of golf club head). The electronic controller 105 can be configured to recognize the unique pattern or locations, associate the unique pattern or locations with a particular golf club head, and process the sensed parameters accordingly.

Figure 3A:
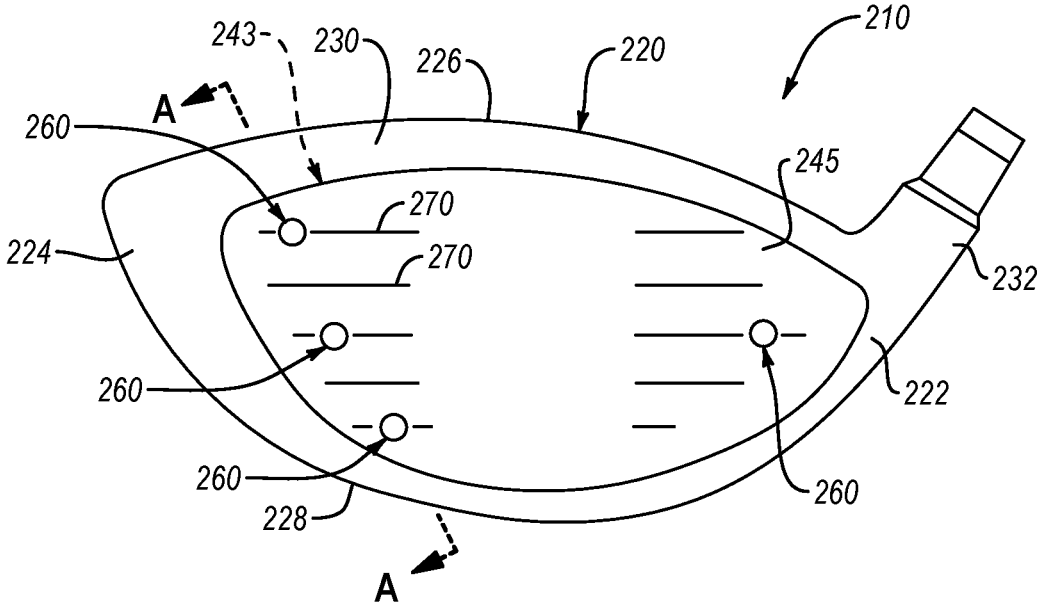
FIG. 3A is a schematic, front elevation view of a golf club head, according to one or more examples of the present disclosure.

In the example of FIG. 3A, the golf club head 210 includes multiple tracking markers 260 located at multiple spaced-apart locations around the strike face 245. For example, each one of the multiple tracking markers 260 is located at a corresponding one of an upper-toe portion, a middle-toe portion, a lower-toe portion, and a middle-heel portion of the strike face 245. In these locations, the optical-based launch monitor is capable of detecting the tracking markers 260 and determining a second set of head presentation parameters (e.g., head speed, swing path, lie angle, impact position, face angle, and the like), greater than the first set of head presentation parameters. For example, the three tracking markers 260 at the toe portion can help to define a plane and the tracking marker 260 at the heel portion helps to define a line relative to the plane, which enables the launch monitor to detect the rotational orientation of the golf club head 210. Additionally, or alternatively, any three of the tracking markers 260 can be used to define a plane, such as tracking markers 260 at the upper-toe portion, the lower-toe portion, and the middle-heel portion. In certain examples, the tracking markers 260 at the middle-toe portion and the middle-heel portion can be positioned relative to the strike face 245 so that a line between the two tracking markers 260 can define the lie angle of the golf club head 210, and the point of bisection of the line can be the preferred impact location or center face of the golf club head 210. It is also recognized that although the tracking markers 260 at the upper-toe portion, the lower-toe portion, and the middle-toe portion in FIG. 3A are not vertically aligned (e.g., diagonally arranged such that the tracking markers 260 are at different toeward locations), in other examples, the tracking markers 260 at the upper-toe portion, the lower-toe portion, and the middle-toe can be vertically aligned (see, e.g., FIGS. 7 and 9).

Figure 4:
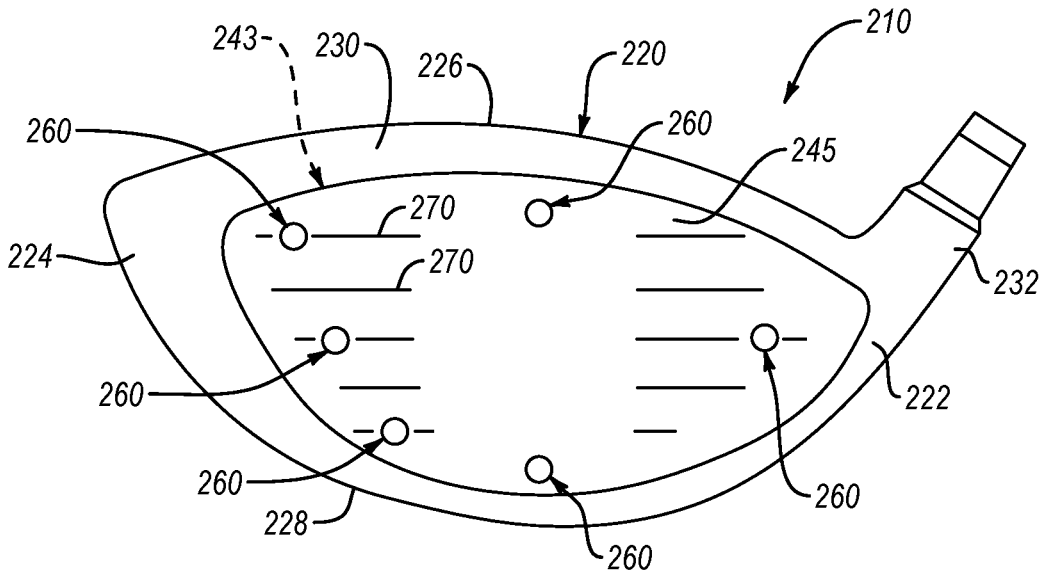
FIG. 4 is a schematic, front elevation view of a golf club head, according to one or more examples of the present disclosure.

Like the example of FIG. 3A, in the example of FIG. 4, the golf club head 210 includes multiple tracking markers 260 located at multiple locations around the strike face 245. The quantity of tracking markers 260 of the example of FIG. 4 is greater than that of the tracking markers 260 of the example of FIG. 3A. For example, in addition to the locations associated with the example of FIG. 3A, the golf club head 210 of FIG. 4 also includes one of the tracking markers 260 at each of an upper-central portion and a lower-central portion of the strike face 245. In these locations, the launch monitor can be capable of detecting the tracking markers 260 and determining a third set of head presentation parameters greater than the second set of head presentation parameters. Conventional stickers applied to the strike face of golf club heads for monitoring launch conditions during a golf swing are not applied within an impact zone of the golf club heads because the stickers are proud of the strike face and can negatively affect impacts with a golf ball. However, because the tracking markers 260 are embedded, they can be placed within the impact zone (e.g., at center face or near center face, such as within a radius of 20 mm, 15, mm, 10 mm, or 5 mm of center face) without affecting the performance of the golf club head. In some instances, moving the heelwardmost tracking marker closer to center face facilitates better detection of the tracking marker by the launch monitor because that location on the strike face is open to the launch monitor longer during a golf swing.

Figure 3B:
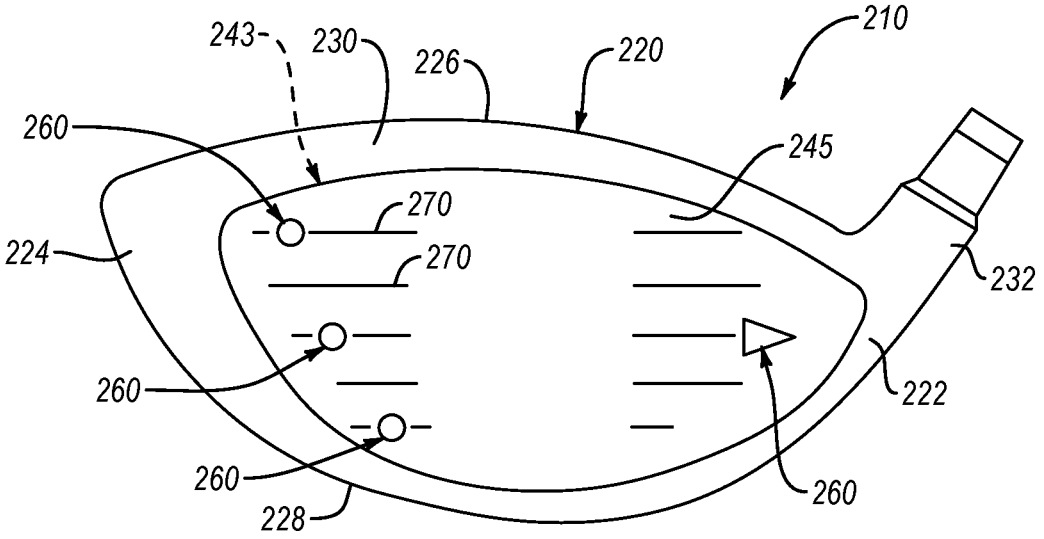
FIG. 3B is a schematic, front elevation view of a golf club head, according to one or more examples of the present disclosure.
Figure 3C:
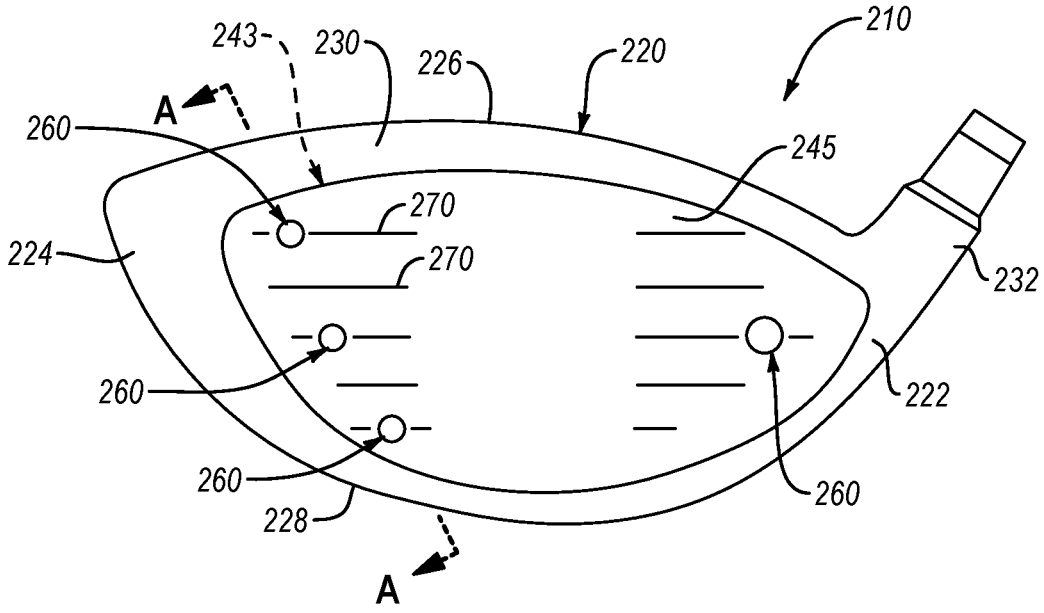
FIG. 3C is a schematic, front elevation view of a golf club head, according to one or more examples of the present disclosure.
Figure 5:
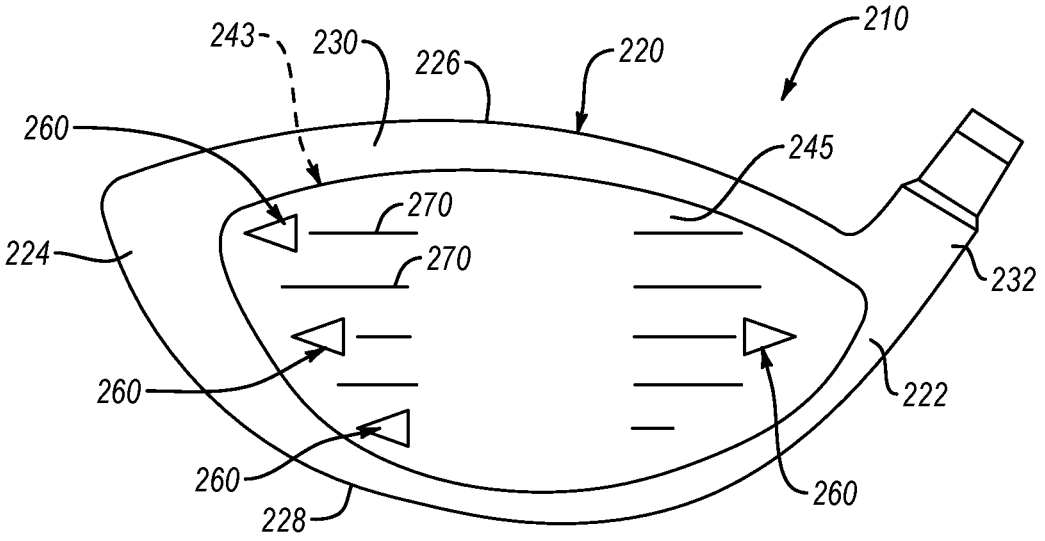
FIG. 5 is a schematic, front elevation view of a golf club head, according to one or more examples of the present disclosure.

A tracking marker 260 can have any of various shapes and sizes. In the illustrated examples of FIGS. 3A and 4, each one of the tracking markers 260 is circular (on or relative to a plane that passes through the tracking markers 260 and is parallel to a loft or loft plane, defined by the strike face, of the golf club head) and has the same size. In contrast, as shown in FIG. 5, each one of the tracking markers 260 has a non-circular shape, such as a triangular shape, and has the same size. Referring to FIG. 3B, in some examples, the tracking markers 260 of the golf club head 210 have different shapes. For example, at least one of the tracking markers 260 of the golf club head 210 can have one shape (e.g., circular) and at least one of the tracking markers 260 of the golf club head 210 can have another shape (e.g., triangular), as shown in FIG. 3B. In the illustrated example, the tracking marker 260 at the heel portion 222 of the strike face 245 is non-circular, such as triangular, oblong, or elongated, and the tracking markers 260 at the toe portion 224 are circular. Referring to FIG. 3C, in some examples, the tracking markers 260 of the golf club head 210 have the same shapes, but have different sizes. For example, at least one of the tracking markers 260 of the golf club head 210 can be larger (e.g., a larger surface area) or smaller (e.g., a smaller surface area) than at least one other of the tracking markers 260 of the golf club head 210. In FIG. 3C, the tracking marker 260 at the heel portion 222 of the strike face 245 is larger than the tracking markers 260 at the toe portion 224 of the strike face 245.

In some examples, the launch monitor 104 is configured to detect a tracking marker 260 have a size within a particular range of sizes. In certain examples, the size of each one of the tracking markers 260 should be large enough to be detectable by the launch monitor 104 and small enough such that the launch monitor 104 can properly identify the location of the tracking marker 260. For example, the launch monitor 104 can be configured to identify the location of the tracking marker 260 by finding a centroid of the tracking marker 260. If the tracking marker 260 is too small, it may not be found by the launch monitor 104 (e.g., because the retroreflectivity is below a minimum threshold) and/or the launch monitor 104 may not be able to determine the centroid of the marker. If the tracking marker 260 is too large, the launch monitor 104 may not be able to identify the periphery of the marker, and thus cannot accurately find the centroid of the marker, or the launch monitor 104 may assign two centroids to a single marker. Each one of the tracking markers 260 can be sized to have a surface area that is any of various percentages of the total surface of the strike face 245. In one example, each one of the tracking markers 260 has a surface area that is less than 5%, less than 3%, or less than 1% of the total surface area of the strike face 245. However, in other examples, each one of the tracking markers 260 has a surface area that is less than 15%, less than 10%, or less than 5% of the total surface area of the strike face 245. In certain examples, a combined surface area of the tracking markers 260 embedded in the forward portion 230 (e.g., embedded under the strike face 245) is between, and inclusive of, 1.5% and 4.5%, or between, and inclusive of, 1.3% and 5% (e.g., 1.6%) of the total surface area of the strike face 245. As used herein, the total surface area of the strike face 245 excludes grooves and textures, and assumes a smooth surface. According to some examples, each one of the tracking markers 260 has a maximum dimension (e.g., a diameter for circular-shaped tracking markers) that is between, and inclusive of, 2 millimeters (mm) and 12 mm, between, and inclusive of, 2 mm and 10 mm, between, and inclusive of, 2 mm and 8 mm, or between, aternd inclusive of, 4.5 mm and 7 mm. According to one example, each one of the tracking markers 260 has a maximum dimension that is between, and inclusive of, 3 mm and 6 mm. According to another example, each one of the tracking markers 260 has a maximum dimension that is between, and inclusive of, 5 mm and 6 mm.

The non-circular shape or size of the tracking markers 260 can be functional, to promote the detectability of the tracking markers 260 by a launch monitor, ornamental, to promote a visual appearance of the golf club head 210, and/or performance-based, to help improve a user's ability to strike a golf ball. For example, because the heel portion 222 of the golf club head 210 is open to detection by the launch monitor 104 for a shorter amount of time compared to the toe portion 224 (due to the heel portion 222 closing sooner than the toe portion 224 during a golf swing), making the tracking marker 260 at the heel portion 222 larger than the tracking markers 260 at the toe portion 224 helps to extend the time the tracking marker 260 at the heel portion 222 is available for detection during a golf swing. Regardless of the size and shape of the tracking markers 260, in some examples, the size and shape of the tracking markers 260 are known by the electronic controller 105, so that the electronic controller 105 can more accurately identify the location of the tracking marker 260 (e.g., by knowing how to determine the center of the tracking marker 260).

A tracking marker 260 is defined by a retroreflective surface that is more retroreflective, for a given wavelength or range of wavelengths, than any viewable surface of the forward portion 230, including the surface of the strike face 245, surrounding the tracking marker 260. As defined herein, a retroreflective surface is a surface configured to receive incident light (generated by a source) at an oblique angle relative to the surface and to redirect the incident light from the surface back to the source as reflected light. Accordingly, a surface that only reflects light back to a source when the light is directed at a 90° angle relative to the surface, and does not reflect light back to the source when the light is directed at an oblique angle relative to the surface, is not a retroreflective surface. Accordingly, as shown in FIG. 1 and described above, the launch monitor 104 generates incident light 111 towards the golf club head 210 and receives retroreflected light 113 retroreflected from the tracking markers 260 on the golf club head 210. This contrasts with a reflective surface, which reflects light from a source away from the source. Accordingly, the tracking marker 260 is distinguished from the surface of the strike face 245 by at least having a greater retroreflectivity than the surface of the surrounding strike face 245. Generally, the retroreflective surface of the tracking marker 260 is defined by a pattern of retroreflective elements, such as spherical beads (with reflective back surfaces), microprisms, or corner reflectors.

Figure 10:
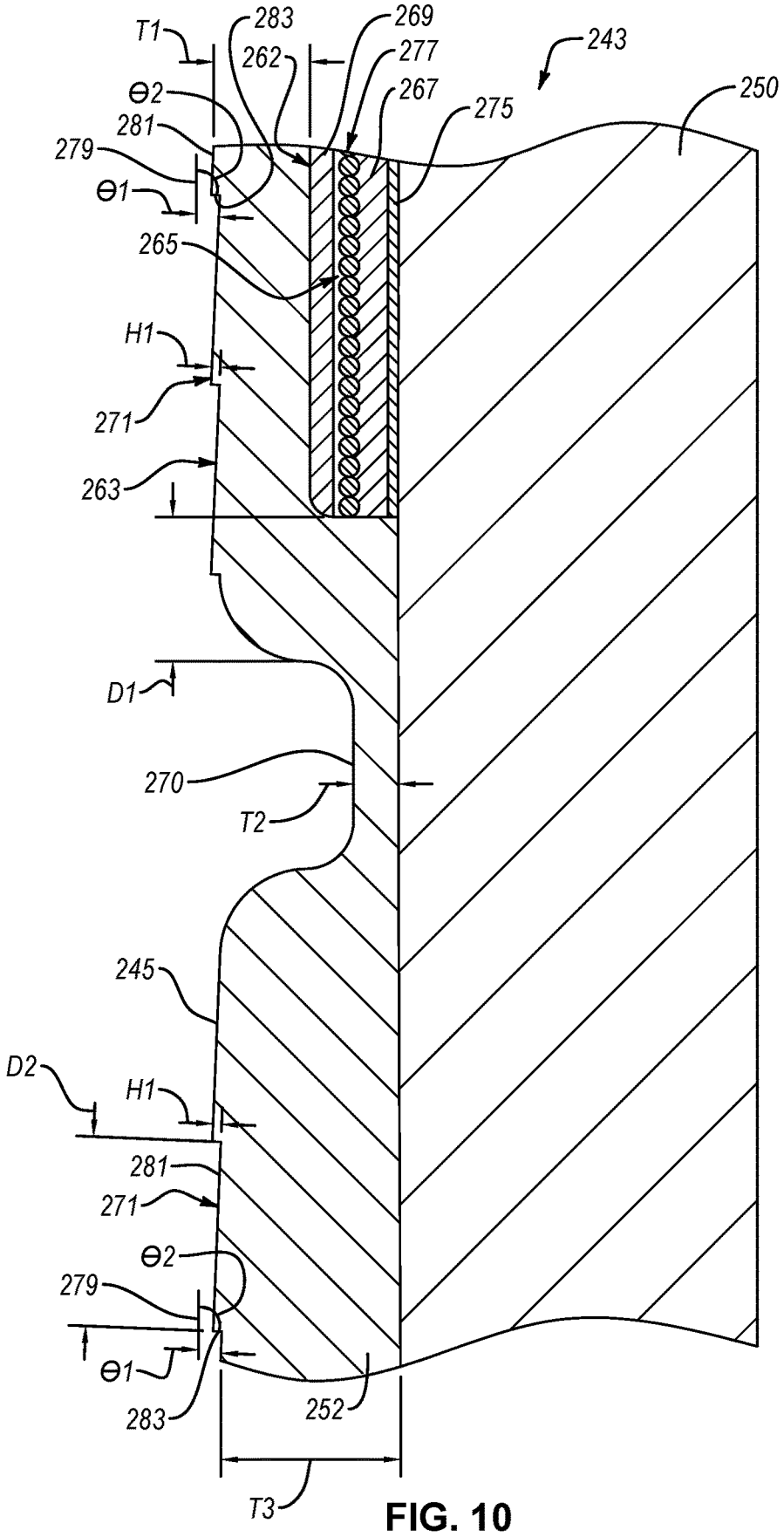
FIG. 10 is a schematic, cross-sectional, side elevation view of a strike plate of a golf club head, taken along a line similar to the line A-A of FIG. 3, according to one or more examples of the present disclosure.
Figure 11:
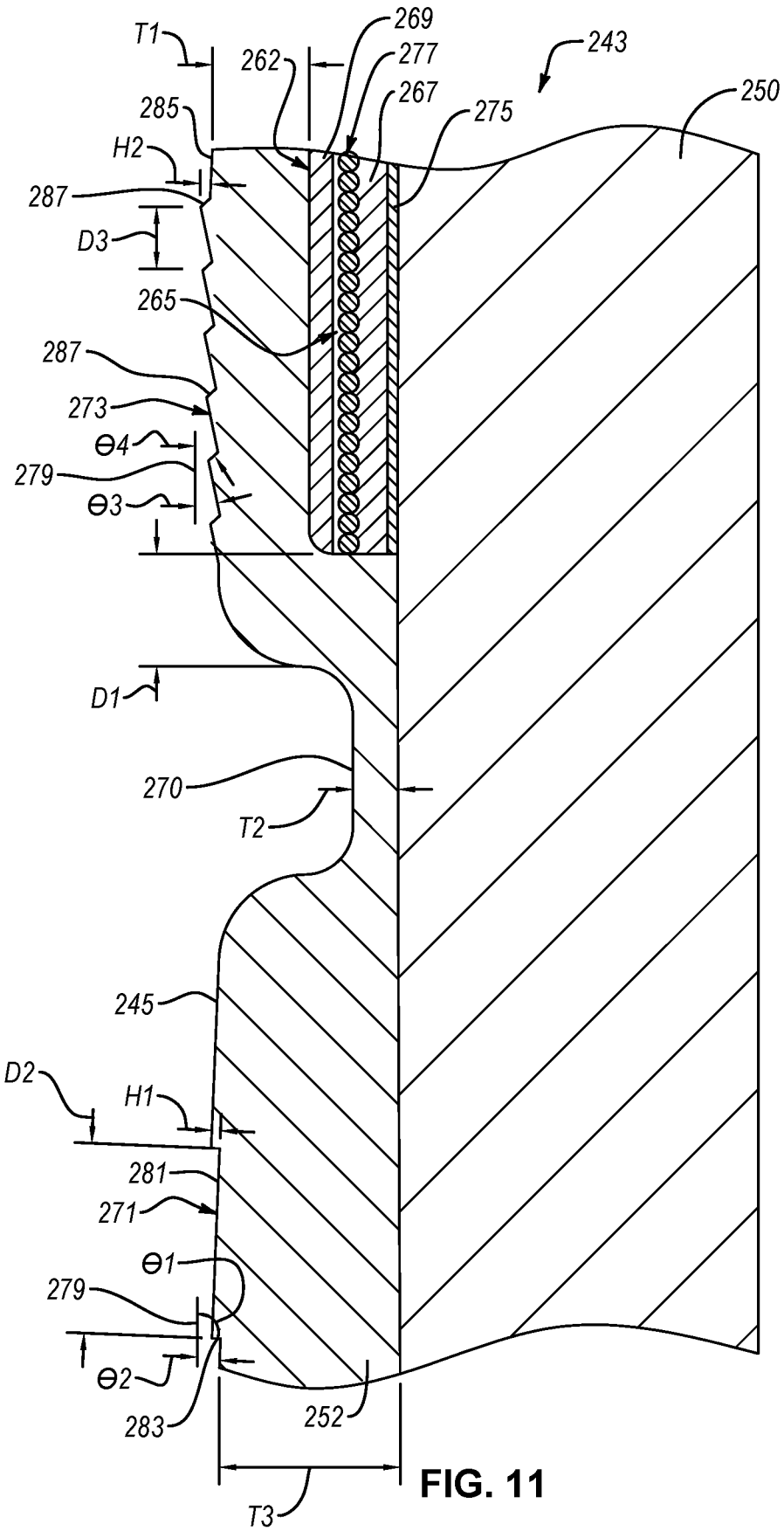
FIG. 11 is a schematic, cross-sectional, side elevation view of a strike plate of a golf club head, taken along a line similar to the line A-A of FIG. 3A, according to one or more examples of the present disclosure.

Referring to FIGS. 10 and 11, according to one example, the tracking marker 260 is a sticker 262 that includes multiple layers. The sticker 262 includes a retroreflective layer 267, an adhesive layer 275 fixed to the retroreflective layer 267, and a polymeric cover 269 fixed to the retroreflective layer 267. The retroreflective layer 267 is interposed between the polymeric cover 269 and the adhesive layer 275. Moreover, the retroreflective layer 267 includes a pattern of retroreflective elements 277, which define a retroreflective surface of the sticker 262. Accordingly, the adhesive layer 275 is opposite the retroreflective surface so that when the adhesive layer 275 is adhered to the FRPM layer 250, the retroreflective surface faces outwardly away from the FRPM layer 250. The retroreflective elements of the pattern of retroreflective elements 277 are tightly packed together. Each one of the retroreflective elements is configured to retroreflect light. In some examples, each retroreflective element 277 is made of an at least partially transparent material, such as glass, and has a reflective rear surface (e.g., retroreflective beads) or a particular shape (e.g., microprisms) so that light entering a retroreflective element is redirected back out of the retroreflective element in a direction that is approximately opposite the direction of the light when it entered the retroreflective element. In certain examples, each retroreflective element 277 does not include a transparent material, but does include a reflective surface having a particular shape (e.g., corner reflectors). The retroreflective layer 267 can further include a substrate to which the pattern of retroreflective elements 277 are fixed. The polymeric cover 269 is transparent such that light is transmissible through the polymeric cover 269 to and from the pattern of retroreflective elements 277. The polymeric cover 269 is fixed relative to the pattern of retroreflective elements 277 such that an air gap 265 is situated between the polymeric cover 269 and the pattern of retroreflective elements 277. The air gap 265 promotes transmission of light into and out from the pattern of retroreflective elements 277. In some examples, an air gap is located between the pattern of retroreflective elements 277 and the adhesive layer 275.

In some examples, the tracking marker 260 is configured to be detectable by a launch monitor, but invisible to or unviewable by the naked eye. In such examples, the tracking marker 260 blocks retroreflected light in the visible spectrum, but does not block retroreflected light in the non-visible spectrum, such as infrared or ultraviolet or radar waves. Accordingly, in certain examples, the tracking marker 260 can include a low or short pass filter that filters out visible light (e.g., filters out light with wavelengths in the visible light spectrum) from the light retroflected from the pattern of retroreflective elements 277. In this manner, only non-visible retroreflected light, which is not perceptible to the human eye, is able to exit from the tracking marker 260 after being retroreflected. The low or short pass filter can be embedded within the tracking marker 260, such as between the polymeric cover 269 and the pattern of retroreflective elements 277, or it can be incorporated into polymeric cover 269.

In some examples, the retroreflectivity of the tracking marker 260 has a retroreflection coefficient of at least 0.7, at least 0.75, at least 0.8, at least 0.85, or at least 0.9. In these or other examples, the retroreflectivity of the tracking marker 260 is at least 40%, at least 50%, at least 60%, at least 70%, at least 80%, or at least 90% greater than the retroreflectivity of the surrounding strike face 245.

Referring to FIG. 8, in examples where the golf club head 210 includes a strike plate 243 that has the FRPM layer 250 and the polymeric layer 252, the polymeric layer 252 is substantially clear or transparent, and the tracking marker 260 is interposed between the FRPM layer 250 and the polymeric layer 252. Accordingly, the tracking marker 260 can be a sticker, such as the sticker 262, and can be detectable through the polymeric layer 252 (e.g., in certain examples, the sticker 262 is viewable, within the visible light spectrum, through the polymeric layer 252). The retroreflectivity of the retroreflective surface of the sticker 262 is greater than the retroreflectivity of the strike face 245 and the outward facing surface 254 of the FRPM layer 250.

According to certain examples, during manufacturing of the golf club head 210, the sticker 262 is adhered to the outward facing surface 254 of the FRPM layer 250, such that a retroreflective surface of the sticker 262 faces outwardly, before the polymeric layer 252 is applied onto the outward facing surface 254. Accordingly, the polymeric layer 252 is applied over the sticker 262, which effectively encapsulates the sticker 262 in the forward portion 230 between the FRPM layer 250 and the polymeric layer 252. In this manner, the tracking marker 260 becomes a permanent part of the golf club head 210 and an entirely of the sticker 262 is recessed relative to the surface of the polymeric layer 252 immediately surrounding the sticker 262. In other words, the tracking marker 260 is permanently embedded in the golf club head 210. As defined herein, a tracking marker 260 is permanently embedded in a golf club head when the tracking marker 260 forms a permanent part of the golf club head and at least a portion of the tracking marker 260 is recessed relative to an immediately surrounding outer surface of the golf club head. In one example, the tracking marker 260 forms a permanent part of the golf club head when the part is not removable from the golf club head without irreversible destruction of, damage to, or deformation of the part or the golf club head. A sticker applied onto the strike face 245, or onto another outer surface of the golf club head 210, is not permanently embedded in the golf club head 210 because it does not form a permanent part of the golf club head (can be easily removed (e.g., peeled away)) and it sits on top of the outer surface of the golf club head without any portion of the sticker being recessed relative to the immediately surrounding portion of outer surface. Although not shown, in some examples, where the strike face 245 is made of a thermoplastic polymeric material, the tracking marker 260 can be co-formed with the strike face 245 such that the strike face 245 and the tracking marker(s) 260 are formed in one molding process.

Referring to FIGS. 8-11, in some examples, the tracking markers 260 are located on the FRPM layer 250 such that scorelines 270 formed in the polymeric layer 252 do not overlap with the tracking markers 260. In other words, in a sole-to-crown direction along the strike face 245, the tracking markers 260 are offset a distance D1 from the scorelines 270 or the tracking markers 260 are between adjacent scorelines 270 (see, e.g., FIG. 10). The presence of scorelines 270 over the tracking markers 260 can negatively affect the performance of the tracking markers 260 by redirecting light away from the tracking markers 260. Accordingly, staggering the tracking markers 260 and the scorelines 270 helps ensure sufficient light from the launch monitor 104 reaches the tracking markers 260.

Figure 9:
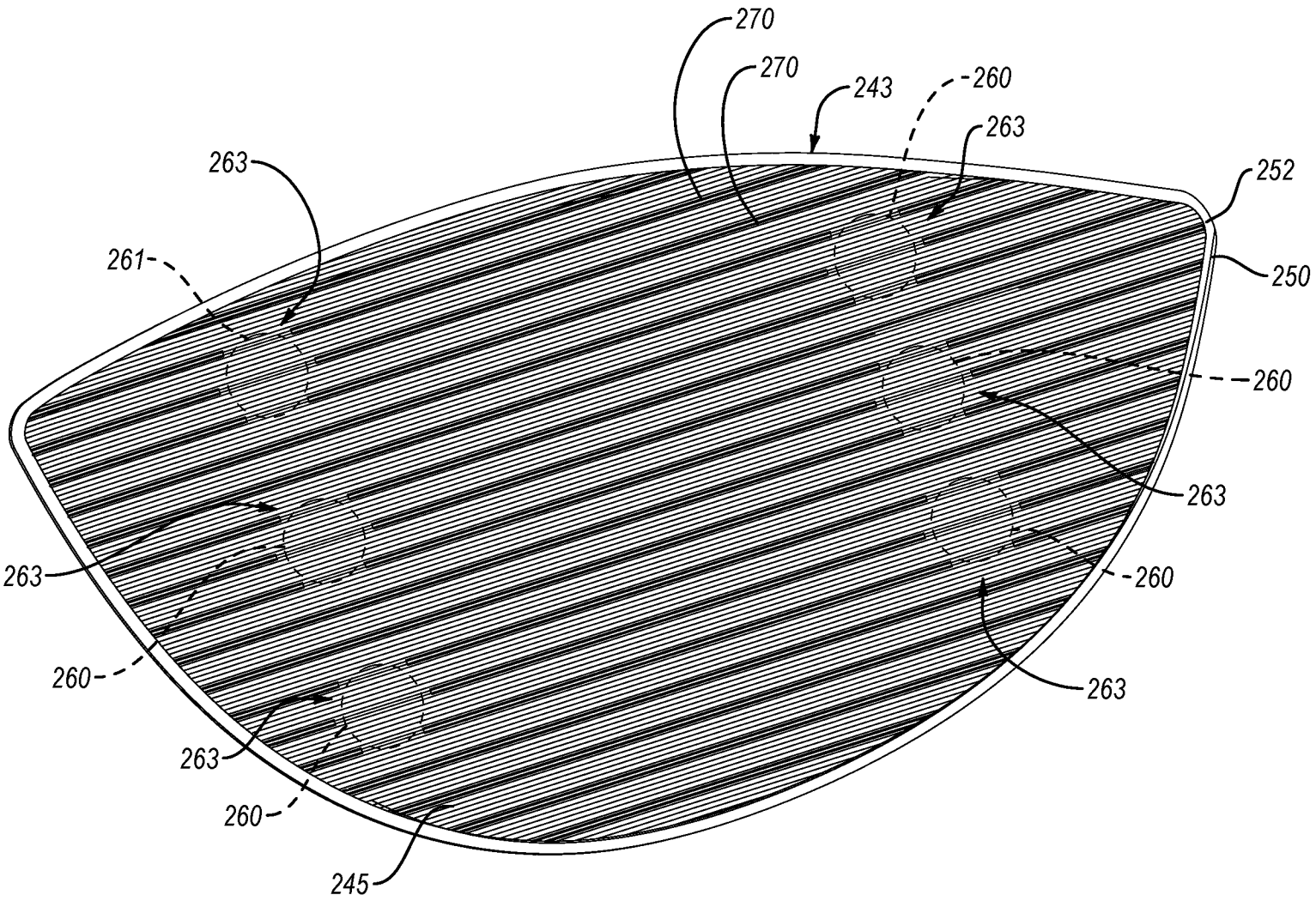
FIG. 9 is a schematic, perspective view of a strike plate of a golf club head, according to one or more examples of the present disclosure.

Referring to FIG. 9, according to certain examples, the polymeric layer 252 includes scoreline-free regions 263 (e.g., windows) at locations associated with desired locations of the tracking markers 260. Each one of the scoreline-free regions 263, in certain examples, divides at least one scoreline 270 into two parts (e.g., intermittent scorelines) that are spaced-apart by the corresponding scoreline-free region 263. As shown, in some examples, each one of the scoreline-free regions 263, in certain examples, divides at least two scorelines 270 into two respective parts. Depending on the spacing of the scorelines 270, one or more of the scoreline-free regions 263, in certain examples, divides at least three scorelines 270 into two respective parts. The tracking markers 260 are applied onto an FRPM layer below corresponding ones of the scoreline-free regions 263 of the polymeric layer 252. Therefore, the tracking markers 260 are shown in dashed lines. The strike plate 243 includes three tracking markers 260 on a toe side of the strike plate 243 and a single tracking marker 260 on a heel side of the strike plate, which is similar to the configuration of the tracking markers 260 of the golf club head 210 of FIG. 3A.

Additionally, to maintain aesthetic symmetry (such as to properly frame a golf ball), in certain applications, dummy markers 261 can be applied onto the FRPM layer below corresponding scoreline-free regions 263 of the polymeric layer 252 on the heel side. According to some examples, the dummy markers 261 are visible within the visible light spectrum, but are not detectable by the launch monitor 104. The undetectability of the dummy markers 261 by the launch monitor 104 is necessary because, in certain examples, the launch monitor 104 is configured to detect a certain quantity of tracking markers (e.g., four), to properly determine the presentation parameters of the golf club head 110, and detection of more than the certain quantity can lead to inaccurate and/or inconsistent results.

In one example, the dummy markers 261 are configured to look like the tracking markers 260 by the naked eye, but do not have retroreflective elements so that light does not retroreflect off of the dummy markers 261, thus the dummy markers 261 are not detectable by the launch monitor 104.

In other examples, the dummy markers 261 have the same retroreflective elements as the tracking markers 260, but do not have a polymeric cover (such as the polymeric cover 269) or a corresponding air gap. Accordingly, the polymeric layer 252, when applied onto the FRPM layer 250, is applied directly onto the retroreflective elements without an air gap, which, as presented above, greatly reduces or prevents light from retroreflecting off of the retroreflective elements, thus rendering the dummy markers 261 undetectable by the launch monitor 104. Alternatively, the dummy markers 261 have the same configuration as the tracking markers 260, but a surface of the polymeric layer 252 directly above the dummy markers 261 has a texture or a surface roughness that prevents or significantly limits the retroreflectivity of light from the dummy markers 261, thus rendering them undetectable by the launch monitor 104. In this alternative example, the surface of the strike face 245 can have three different textures, including a first texture occupying the majority of the strike face 245 at locations away from the tracking markers 260 and the dummy markers 261, a second texture (different than the first texture) at locations over the tracking markers 260, and a third texture (different than the first texture and the second texture) at locations over the dummy markers 261. In yet other examples, a low or short pass filter, configured to prevent retroreflected light from passing through the filter, can be incorporated into each one of the dummy markers 161.

Referring to FIG. 10, in some examples, the strike face 245, defined by the polymeric layer 252, is textured. More specifically, the strike face 245 includes textured zones or zones on the strike face 245 that have a textured surface. In certain examples, the entirety of the strike face 245, excluding the scorelines 270, is textured with the same texture. For example, as shown in FIG. 10, each of the textured zones 271 between the scorelines 270 has the same texture. The texture of the textured zones is defined by a repeating pattern of surface features or undulations, which are configured to help direct light into an underlying tracking marker(s) 260. In certain examples, texture, as defined herein, contrasts with surface roughness associated with any surface in that the texture has a repeating pattern and surface roughness does not.

In some examples, as shown in FIG. 10, the texture of the texture zones 270 has a sawtooth configuration with a repeating pattern of asymmetrical sawtooth or non-symmetrical triangular shapes (i.e., cross-sectional shapes when viewed along a plane that is perpendicular to the strike face 245). Each sawtooth has a maximum height H1 (e.g., peak-to-trough height), which is defined relative to a minimum height of the sawtooth. The height H1 is between, and inclusive of, 0.014 mm and 0.022 mm, such as 0.018 mm. Also, each sawtooth of the textured zones 271 has a width D2 from peak to peak or from trough to trough. In some examples, the width D2 is between, and inclusive of, 0.38 mm and 0.42 mm. Moreover, the triangular shape of the sawtooth can have any of various configurations defined by the angle of the surfaces relative to an overall (or average) plane 279 (e.g., loft) of the of the strike face 245. In FIG. 10, a first surface 281 of each sawtooth defines a first angle θ1 relative to the overall plane 279, and a second surface 283 of each sawtooth defines a second angle θ2 relative to the overall plane 279. In some examples, the second angle θ2 is greater than the first angle θ1 (e.g., the first angle θ1 can be +/−3° or +/−2° relative to the overall plane or loft of the strike face 245). The second angle θ2 can be between, and inclusive of, 85° and 90° in some examples. Additionally, in some examples, the first surface 281 can have a greater width than the second surface 283. However, in other examples, the first angle θ1 is equal to the second angle θ2 and the first surface 281 has a width equal to that of the second surface 283, so that each one of the surface features has a symmetrical triangular shape. The transition between the first surface 281 and the second surface 283 can be sharp or rounded. Additionally, the transition from one sawtooth to the next adjacent sawtooth can be sharp or rounded.

In other examples, each one of the surface features of the repeating pattern of surface features has a cross-sectional shape, along a plane perpendicular to the strike face 245, that is not triangular. For example, in one implementation, each surface feature can have a convex, semi-circular or semi-oval, rounded outer surface, or a concave, semi-circular or semi-oval, rounded outer surface.

The texture of the textured surface of the strike face 245 promotes retroreflectivity of light from the tracking markers 260. In contrast, it is recognized that the lack of texture (e.g., general non-patterned surface roughness or, alternatively, smoothness) hinders the retroreflectivity of light. This is because textured surfaces on the polymeric layer 252 help to direct light through the polymeric layer 252 and into the tracking markers 260, whereas light tends to reflect off of non-textured or smooth surfaces of the polymeric layer 252 without passing through the polymeric layer 252. In other words, the retroreflectivity of light from the tracking markers 260 is more efficient when the strike face 245 is textured than when it is not textured. Moreover, some textures promote retroreflectivity from the tracking markers 260 better than other textures. Additionally, it is recognized that the texture of the strike face 245 promotes the performance of the golf club head 210 by affecting how the golf ball reacts to the strike face 245 upon impact. As with retroreflectivity of the tracking markers 260, some textures promote performance characteristics of the golf club head 210 better than other textures. In certain examples, such as shown in FIG. 10, some textures promote both the performance characteristics of the golf club head 210 and the retroreflectivity of the tracking markers 260, such that the entirety of the strike face 245, excluding the scorelines 270, has the same texture (i.e., the same textured zones 271).

However, in other examples, such as shown in FIG. 11, the texture of the strike face 245 over the tracking markers 260 is different than the texture of the strike face 245 away from the tracking markers 260. In FIG. 11, the strike face 245 includes the textured zone 271 at a location away from or offset from the tracking marker 260, and includes a second textured zone 273 over or at the location of the tracking marker 260 (e.g., within the scoreline-free regions 263 or windows). In one example, the strike face 245 includes multiple second textured zones 273 each at a corresponding one of the scoreline-free regions 263, and multiple textures zones 271 surrounding the scoreline-free regions 263 and located between the scorelines 270. The texture of the textured zone 271 is configured to promote performance characteristics of the golf club head 210, and the texture of the second textured zone 273, which is different than the texture of the textured zone 271, is configured to promote the retroreflectivity of light from the tracking marker 260. The second textured zone 273 includes a repeating pattern of surface features or undulations, like the textured zone 271, however, each surface feature of the second textured zone 273 is configured differently than each feature of the textured zone 271.

The texture of the second textured zone 273 has a sawtooth configuration with a repeating pattern of sawtooth or triangular shapes. Each sawtooth of the second textured zone 273 has a maximum height H2, which is defined relative to a minimum height of the sawtooth. Also, each sawtooth of the textured zones 273 has a length D3 from peak to peak or from trough to trough. In FIG. 11, a second-textured-zone first surface 285 of each sawtooth defines a third angle θ3 relative to the overall plane, and a second-textured-zone second surface 287 of each sawtooth defines a fourth angle θ4 relative to the overall plane. In some examples, the fourth angle θ4 is greater than the third angle θ3. Additionally, in some examples, the second-textured-zone first surface 285 can have a greater width than the second-textured-zone second surface 287. However, in other examples, the third angle θ3 is equal to the fourth angle θ4 and the second-textured-zone first surface 285 has a width equal to that of the second-textured-zone second surface 287. The transition between the second-textured-zone first surface 285 and the second-textured-zone second surface 287 can be sharp or rounded. Additionally, the transition from one sawtooth to the next adjacent sawtooth of the second textured zone 273 can be sharp or rounded. One or more of the angles or widths (e.g., areal density) of the surface features of the second textured zone 273 can be different than the angles or widths of the surface features of the textured zone 271. For example, as shown, the surface features of the second textured zone 273 can have a smaller width D3 than the width D2 of the textured zone 271 such that the areal density of the surface features of the second textured zone 273 is greater than that of the surface features of the textured zone 271. Also, the first angle θ1 of the textured zone 271 can be different (e.g., smaller) than the third angle θ3 of the second textured zone 273, and the second angle θ2 of the textured zone 271 can be different (e.g., larger) than the fourth angle θ4 of the second textured zone 273.

Referring to FIGS. 10 and 11, retroreflectivity of the tracking markers 260 can also be affected by the thickness T1 of the polymeric layer 252 between the tracking markers 260 and the strike face 245 (i.e., the depth of the tracking markers 260 below the strike face 245). According to various examples, the thickness T1 of the polymeric layer 252 at the tracking markers 260 is greater than a thickness T2 of the polymeric layer 252 at or below the scorelines 270. In some examples, a ratio of the thickness T1 of the polymeric layer 252 at the tracking markers 260 to the thickness T2 of the polymeric layer 252 at the scorelines 270 is between, and inclusive of, 2 and 4, such as 3.3. The thickness T1 of the polymeric layer 252 at the tracking markers 260 is less than a thickness T3 of the polymeric layer 252 at locations away from the scorelines 270 and away from the tracking markers 260. In some examples, a ratio of the thickness T1 of the polymeric layer 252 at the tracking markers 260 to the thickness T3 of the polymeric layer 252 away from the scorelines 270 and the tracking markers 260 is between, and inclusive of, 0.3 and 0.7, such as 0.5. In certain examples, each one of the tracking markers 260 has a thickness (excluding a backing paper if applicable) between, and inclusive of, 0.05 mm and 0.2 mm (e.g., 0.13 mm). In some examples, the thickness T3 of the polymeric layer 252 is between, and inclusive of, 0.35 mm and 0.45 mm (e.g., 0.40 mm). Accordingly, in some examples, the thickness T1 of the polymeric layer at or over the tracking markers 260 is between, and inclusive of, 0.15 mm and 0.4 mm. According to certain examples, the thickness T2 of the polymeric layer 252 at or below the scorelines 270 is between, and inclusive of, 0.07 mm and 0.11 mm.

According to some examples, the strike plate 243 can be configured according to one or more examples of a strike plate defined in U.S. Pat. No. 11,596,841, issued Mar. 7, 2023, which is incorporated herein in its entirety. For example, the FRPM layer 250 of the strike plate 243 can include a plurality of composite prepreg plies and the polymeric layer 252 of the strike plate 243 can have a thickness between, and inclusive of, 0.1 mm and 3.0 mm, or between, and inclusive of, 0.05 mm and 3.0 mm. The polymeric layer 252 can have a plurality of surface features so that a mean roughness of the strike face 245 is between, and inclusive of, 2.5 micrometers and 5 micrometers, and a thickness of the polymeric layer 252 can be between, and inclusive of, 0.2 mm and 1.2 mm. Alternatively, the polymeric layer 252 can have a plurality of surface features so that a mean roughness of the strike face 245 is between, and inclusive of, 2.5 micrometers and 5 micrometers, and a thickness of the polymeric layer 252 can be between, and inclusive of, 0.05 mm and 1.2 mm. A peak-to-trough height of the surface features can be between, and inclusive of, 20 micrometers and 30 micrometers, or between, and inclusive of, 20 micrometers and 60 micrometers.

In some examples, retroreflectivity of the tracking markers 260 can also be affected by the orientation of the surface features of the texture formed in the polymeric layer 252. In the illustrated examples of FIGS. 10 and 11, the surface features are oriented downward (e.g., soleward) so that the surface features extend lengthwise in a heel-to-toe direction and widthwise in a sole-to-crown direction, and so that the less angled surface of the surface features faces upwardly toward the crown and the more angled surface of the surface features faces downwardly toward the sole. However, it is recognized that other orientations may be more effective in certain examples, depending on the configuration of the surface features. In one example, the surface features are similar to those shown in FIGS. 10 and 11, but oriented 180-degrees relative to those in FIGS. 10 and 11, so that the surface features are oriented upward (e.g., crownward), which means the surface features extend lengthwise in a heel-to-toe direction and widthwise in a sole-to-crown direction, and the less angled surface of the surface features faces downwardly toward the sole and the more angled surface of the surface features faces upwardly toward the crown. In other examples, the surface features are similar to those shown in FIGS. 10 and 11, but oriented +/−90-degrees relative to those in FIGS. 10 and 11, so that the surface features are oriented sideways (e.g., toward the toe or toward the heel), which means the surface features extend lengthwise a sole-to-crown direction and widthwise in a heel-to-toe direction, and the less angled surface of the surface features faces toward the toe or heel and the more angled surface of the surface features faces toward the other of the toe or heel.

Figure 12:
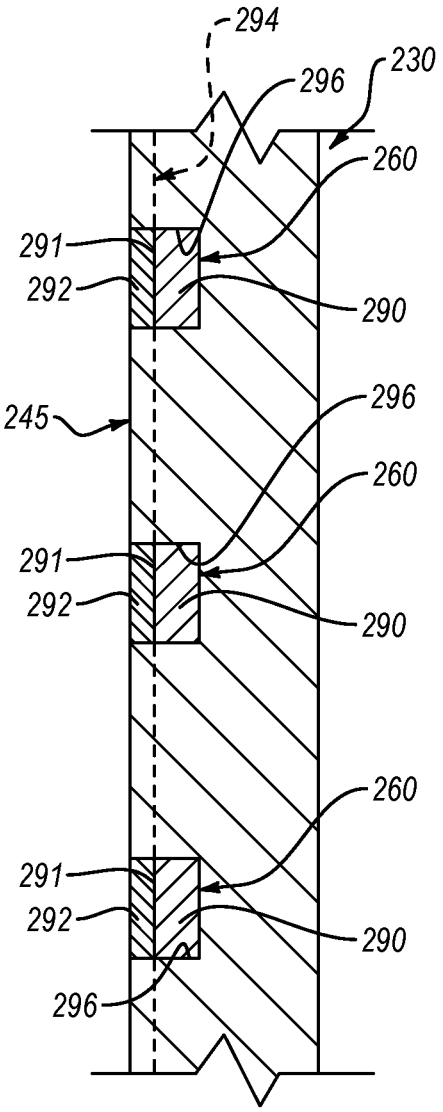
FIG. 12 is a schematic, cross-sectional, side elevation view of a strike plate of a golf club head, taken along a line similar to the line A-A of FIG. 3A, according to one or more examples of the present disclosure.

In one example, as shown in FIG. 12, the strike face 245 is made of a metallic material (e.g., fairway metals, irons, wedges, putters, etc.) or a non-FRPM material (e.g., putters). For example, the forward portion 230 can be or include a strike plate made from a metallic material (or can be co-formed with the rest of the metallic portions of the body of the golf club head) or a non-FRPM material. The forward portion 230 includes the tracking markers 260. For each tracking marker 260, a recess 296 (or blind hole) is formed in the forward portion 230 (e.g., the strike face 245). The tracking marker 260 is an insert 290 that is inserted into the recess 296. The insert 290 includes a retroreflective surface 291 that faces outwardly when the insert 290 is inserted into the recess 296. The forward portion 230 also includes a cover 292, which is made of a polymer material in one example. The cover 292 is also inserted into the recess 296 over the insert 290. The cover 292 helps to retain and protect the insert 290, and defines a portion of the strike face 245. Additionally, the cover 292 is at least partially transparent so that the retroreflective surface 291 is viewable from outside the golf club head 210. Furthermore, in some examples, the outer surface of the cover 292 is textured to have a repeating pattern of surface features as described above. The insert 290 can be a sticker, as presented above. Additionally, or alternatively, in certain examples, the recess 296 can be angled toward an anticipated location of a launch monitor (e.g., toeward) so that the retroreflective surface 291 of the insert 290, also being angled, promotes retroreflectivity of light back to the launch monitor. Although described as being formed in a metallic material, in some examples, a recess (similar to the recess 296 described above) can be formed in the FRPM layer 250 of the strike plate 243 and the tracking marker 260 can be inserted into the recess before the polymeric layer 252 is applied over the FRPM layer 250 and the tracking marker 260. The insert 290 of FIG. 12 is permanently embedded because it is intended to be permanently affixed to the golf club head and an entirety of the insert 290 is recessed relative to the immediately surrounding outer surface of the golf club head (e.g., the strike face 245).

According to some examples, the forward portion 230 optionally includes a physical vapor deposition (PVD) layer 294 applied onto an underlying metallic layer of the forward portion 230. The PVD layer 294 defines the strike face 245. Moreover, the recess 296 is partially formed in the PVD layer 294. Whether the forward portion 230 includes the PVD layer 294 or not, the insert 290 and the cover 292 are sized (e.g., have relative thicknesses) such that an outer surface of the cover 292 is flush with the strike face 245, protrudes no more than 0.15 mm from the strike face 245, or is sunken no more than 0.1 mm below the strike face 245. In some instances, the recess 296 may be countersunk or counterbored to provide greater bonding area to the cover 292.

Figure 13:
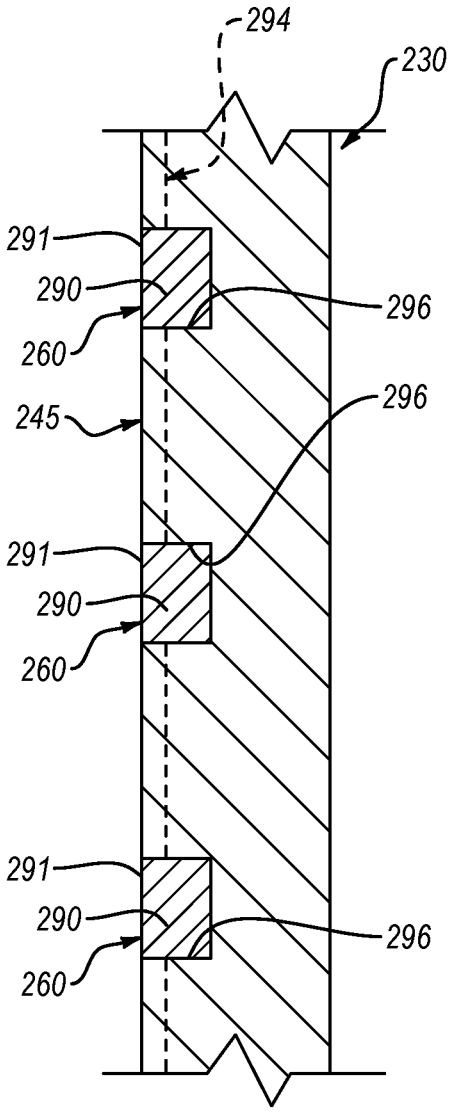
FIG. 13 is a schematic, cross-sectional, side elevation view of a strike plate of a golf club head, taken along a line similar to the line A-A of FIG. 3A, according to one or more examples of the present disclosure.

In another example, as shown in FIG. 13, the strike face 245 is made of a metallic material and the recesses 296 are formed in the forward portion 230. Similar to the example of FIG. 12, the tracking marker 260 is an insert 290 that is inserted into the recess 296. The insert 290 includes a retroreflective surface 291 that faces outwardly when the insert 290 is inserted into the recess 296. However, unlike the example of FIG. 12, the forward portion 230 does not include a cover 292. Accordingly, the retroreflective surface 291 of the insert 290 or an integrated cover of the insert 290 of FIG. 13 defines a portion of the strike face 245. According to some examples, the forward portion 230 optionally includes a physical vapor deposition (PVD) layer 294. Therefore, in some examples, the recess 296 is partially formed in the PVD layer 294. Whether the forward portion 230 includes the PVD layer 294 or not, in some examples, the insert 290 is sized (e.g., has a thickness) such that the retroreflective surface 291 of the insert 290 is flush with the strike face 245, protrudes no more than 0.15 mm from the strike face 245, or is sunken no more than 0.1 mm below the strike face 245. In some examples, the insert can be similar to or include a sticker, as described above in greater detail. The insert 290 of FIG. 13 is permanently embedded because it is intended to be permanently affixed to the golf club head and a majority, if not an entirety) of the insert 290 is recessed relative to the immediately surrounding outer surface of the golf club head (e.g., the strike face 245). Accordingly, a tracking marker 260 or an insert 290 can be considered permanently embedded even if a portion of the tracking marker or insert is not covered by another layer, if a portion of the tracking marker or insert is recessed as defined herein. When the tracking marker or the insert is not covered by another layer, such as in FIG. 13, the outermost surface of the tracking maker or the insert protrudes no more than 0.05 mm relative to the immediately surrounding outer surface and is sunken no more than 0.1 mm or 0.2 mm relative to the immediately surrounding outer surface.

The formation of the recesses 296 in FIGS. 12 and 13 is performed via a machining process, such as with a computerized numerical control (CNC) machine, in certain examples. Alternatively, in some examples, the recesses 296 can be formed concurrently with the rest of the forward portion 230 via a casting process.

Although the examples of the forward portion 230 in FIGS. 12 and 13 can be associated with a driver golf club head, it is recognized that the examples of the forward portion 230 shown in FIGS. 12-13 are equally applicable to the forward portion of fairway-metal golf club heads, hybrid golf club heads, iron golf club heads, and putter golf club heads, such as those described hereafter. Accordingly, the tracking markers described below in association with fairway-metal golf club heads, hybrid golf club heads, iron golf club heads, and putter golf club heads can be formed in the same manner as described above in association with the driver golf club head.

Figure 14:
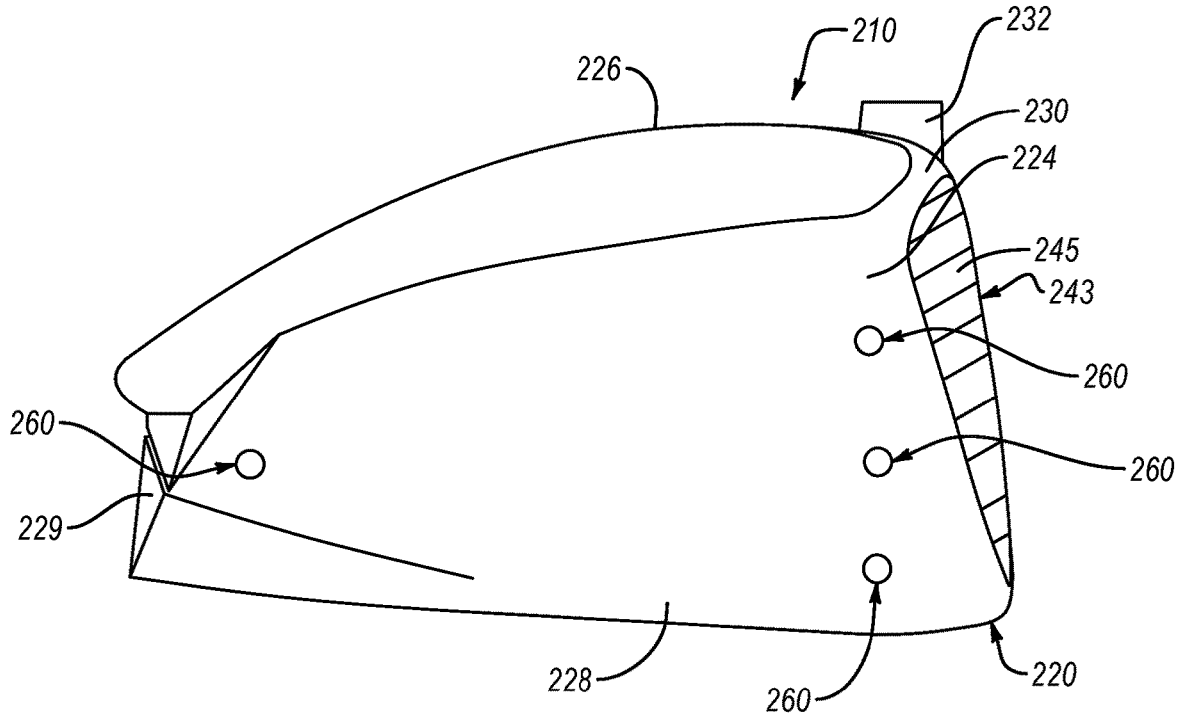
FIG. 14 is a schematic, side elevation view of a golf club head, according to one or more examples of the present disclosure.
Figure 15:
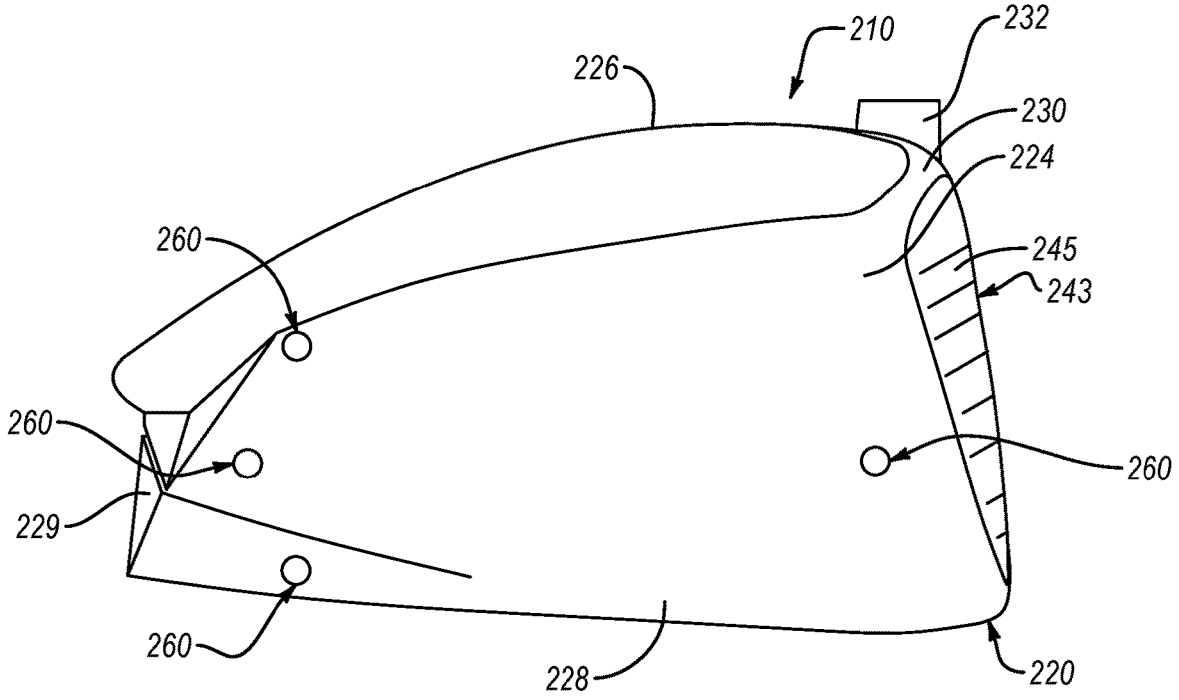
FIG. 15 is a schematic, side elevation view of a golf club head, according to one or more examples of the present disclosure.
Figure 16:
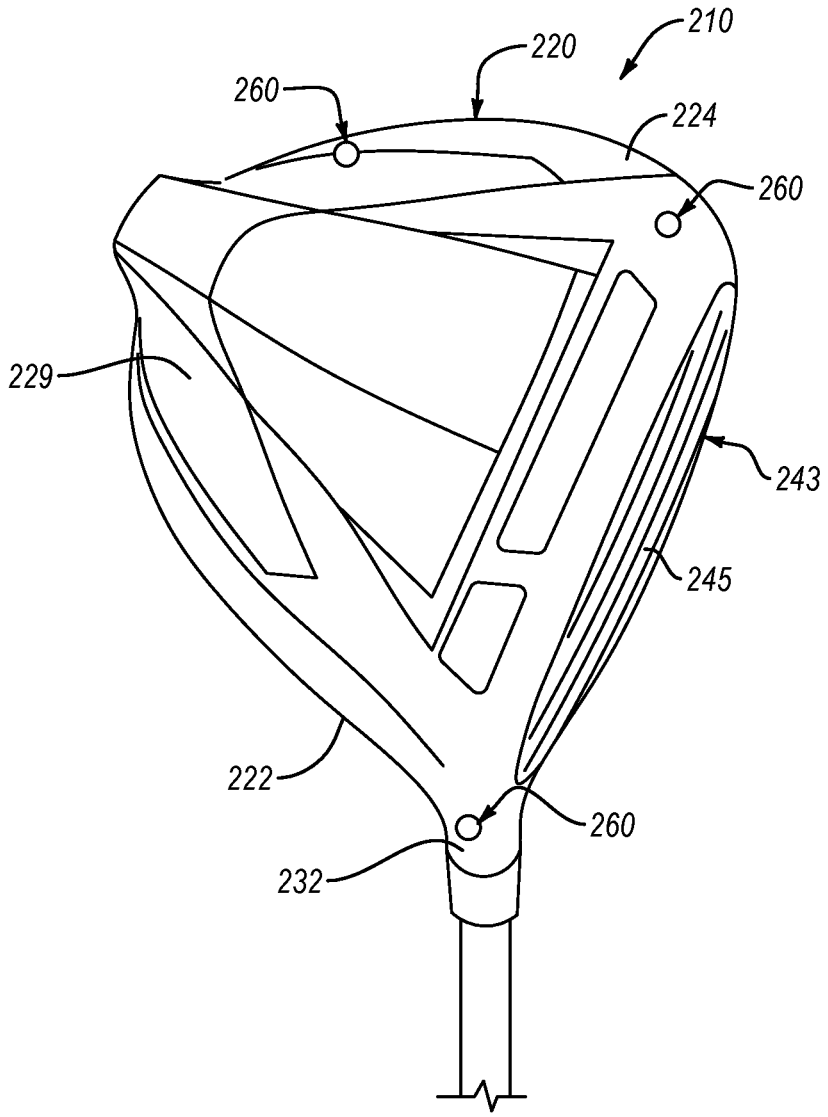
FIG. 16 is a schematic, perspective view of a golf club head, according to one or more examples of the present disclosure.

Although the examples of the golf club head 210 shown in FIGS. 3A-13 have one or more tracking markers 260 at one or more locations around the strike face 245, in other examples, such as shown in FIGS. 14-16, instead of or in addition to tracking markers 260 at the strike face 245, the golf club head 210 includes one or more tracking markers 260 at portions of the golf club head 210 other than the strike face 245. In the example shown in FIG. 14, the golf club head 210 includes multiple tracking markers 260 at multiple locations around the toe portion 224 or on a toe side of the golf club head 210. More specifically, the golf club head 210 of FIG. 14 has three tracking markers 260 on the toe portion 224 at forward locations (e.g., spaced apart in a crown-to-sole direction) and one tracking marker 260 on the toe portion 224 at a rearward location. Alternatively, in the example shown in FIG. 15, the golf club head 210 includes multiple tracking markers 260 at multiple locations around the toe portion 224 or on a toe side of the golf club head 210. However, the golf club head 210 of FIG. 15 has three tracking markers 260 on the toe portion 224 at rearward locations (e.g., spaced apart in a crown-to-sole direction) and one tracking marker 260 on the toe portion 224 at a forward location. In certain examples, such as shown in FIG. 16, the golf club head 210 has at least one tracking marker 260 at a location on the heel portion 222 or the hosel 232 of the golf club head 210. With one or more tracking markers 260 on the heel portion 222 or the hosel 232, a depth of the golf club head 210 can be more easily defined and identified by the launch monitor.

The tracking markers 260, at locations on the golf club head 210 other than the strike face 245, can be formed in a manner similar to the tracking markers 260 on the strike face 245 to be a permanent part of the golf club head 210. For example, the tracking markers 260 on the toe portion 224, the hosel 232, or other portions of the golf club head 210 can be stickers or inserts embedded between two layers of the golf club head 210. It is also recognized that, for golf club heads with multiple tracking markers, as disclosed herein, different types of tracking markers can be used on the same golf club head. For example, the tracking markers on the strike face can be of a different type or formed differently than the tracking markers on other portions of the golf club head.

Referring to FIGS. 17-20, examples of a golf club head 310 are shown. The golf club head 310 is a fairway-metal golf club head or a hybrid golf club head. The golf club head 310 includes features similar to those of the golf club head 210, with like numbers referring to like features. For example, the golf club head 310 includes a body 320 having a heel portion 322, a toe portion 324, a crown portion 326, a sole portion 328, and a forward portion 330. Although not shown, the golf club head 310 also includes a rearward portion, opposite the forward portion 330. Additionally, the golf club head 310 includes a skirt portion that defines a transition region where the golf club head 310 transitions between the crown portion 326 and the sole portion 328. Accordingly, the skirt portion is located between the crown portion 326 and the sole portion 328, and extends about a periphery of the golf club head 310. The heel portion 322 defines a hosel 332 of the golf club head 310.

Figure 17:
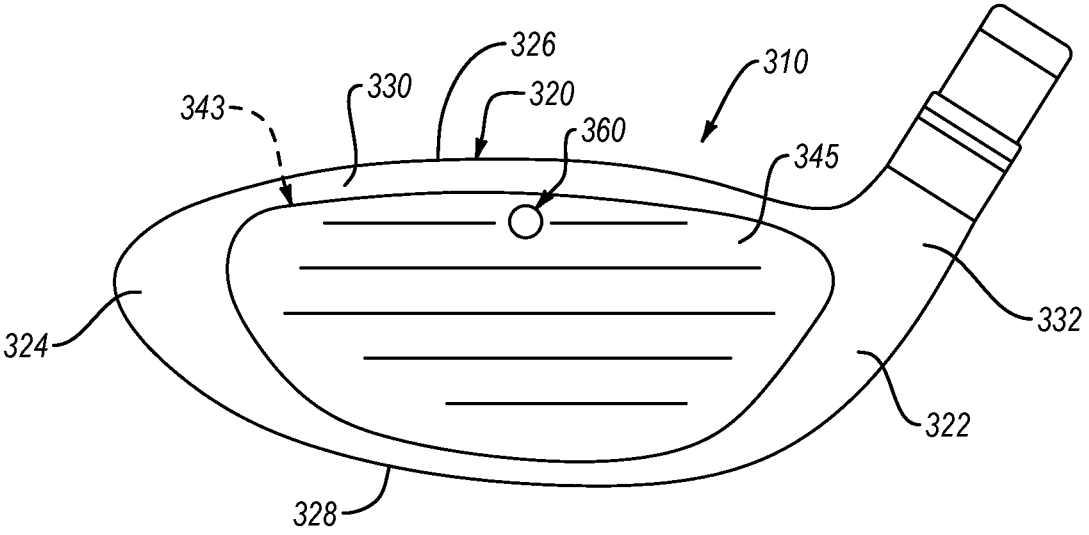
FIG. 17 is a schematic, front elevation view of a golf club head, according to one or more examples of the present disclosure.
Figure 18:
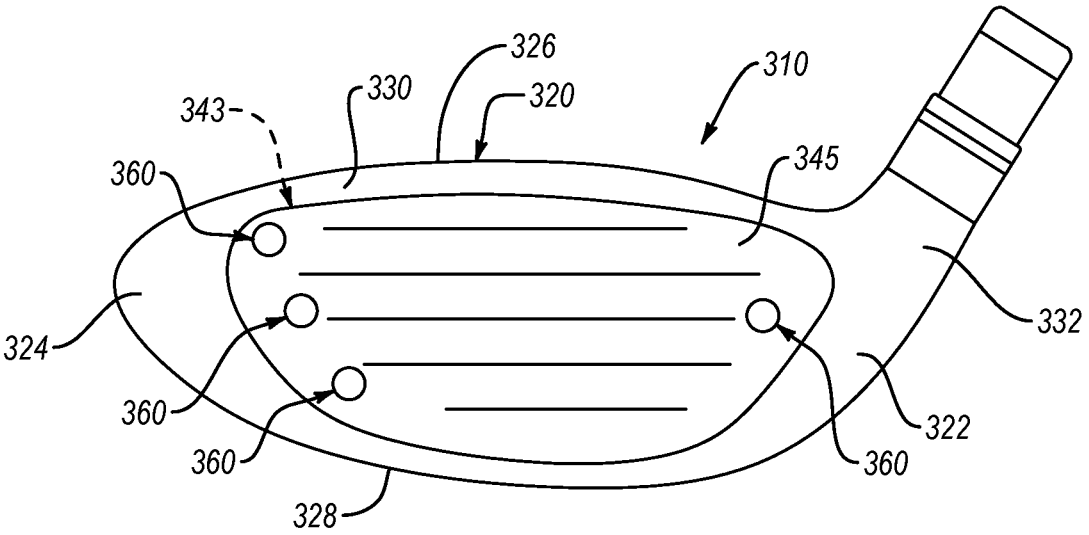
FIG. 18 is a schematic, front elevation view of a golf club head, according to one or more examples of the present disclosure.
Figure 19:
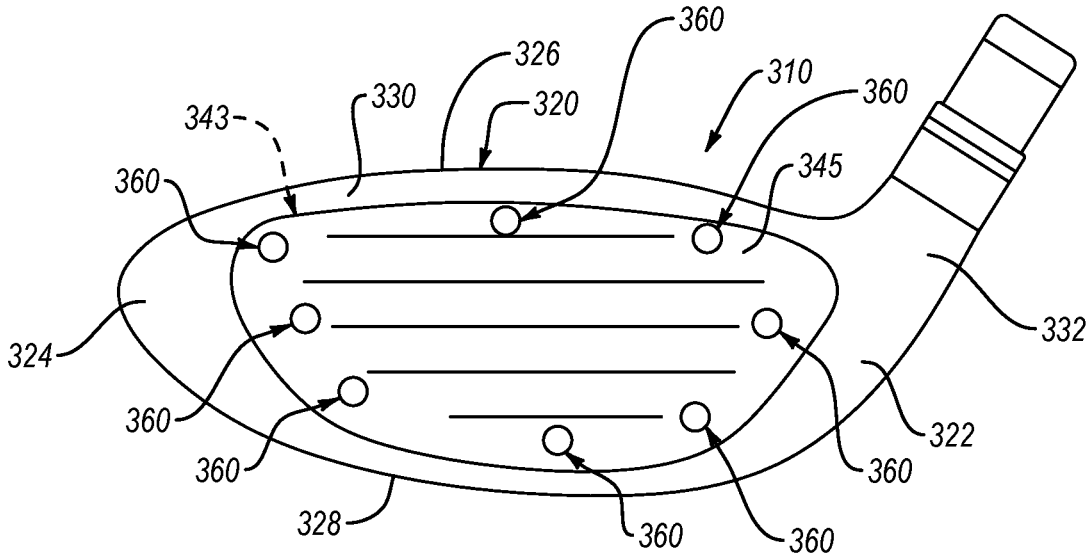
FIG. 19 is a schematic, front elevation view of a golf club head, according to one or more examples of the present disclosure.
Figure 20:
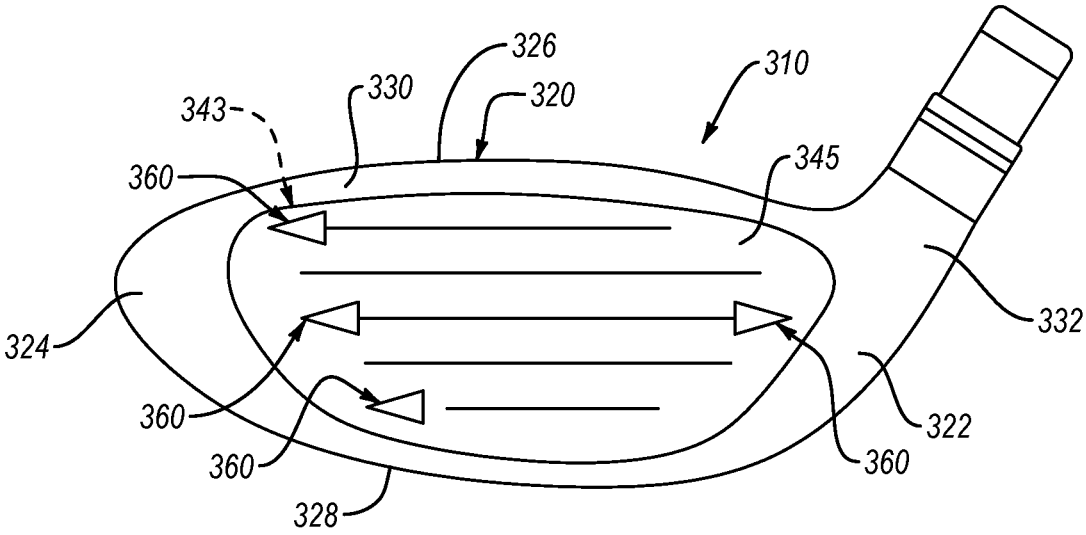
FIG. 20 is a schematic, front elevation view of a golf club head, according to one or more examples of the present disclosure.

The forward portion 330 defines a strike face 345 that can be co-formed with one or more other portions of the body 320 or formed separately from any other portion of the body 320. The forward portion 330 of the golf club head 310 also includes at least one tracking marker 360. The configuration and location of the tracking marker 360 on the forward portion 330 of the golf club head 310 can be similar to that of the tracking marker 260 of the golf club head 210. In the example of FIG. 17, the golf club head 310 includes a single tracking marker 360 that is located at an upper-central portion of the strike face 345. In the example of FIG. 18, the golf club head 310 includes multiple tracking markers 360 located at multiple spaced-apart locations around the strike face 345, such as at an upper-toe portion, a middle-toe portion, a lower-toe portion, and a middle-heel portion of the strike face 345. In the example of FIG. 19, the golf club head 310 also includes multiple tracking markers 360 located at multiple locations around the strike face 345. However, the quantity of tracking markers 360 of the example of FIG. 19 is greater than that of the tracking markers 360 of the example of FIG. 18. In contrast, as shown in FIG. 20, each one of multiple tracking markers 360 has a non-circular shape, such as a triangular shape.

The tracking markers 360 are embedded in the forward portion 330 in a manner similar to that shown in FIGS. 8-11 or FIGS. 12-13. In other words, the strike face 345 can be defined by a polymeric layer of a strike plate 343 that includes an FRPM layer, in some examples, or by a metallic material of a strike plate 343 or a surface co-formed with other portions of the body 320, in other examples. In the former examples, the tracking markers 360 are stickers interposed between an FRPM layer and a polymeric layer. In the latter examples, the tracking markers 360 are inserts inserted into recesses formed in the strike face. The tracking markers 360 can be located in any of various alternative or additional locations around the golf club head 310, other than the strike face 345, in a manner similar to that described above with regard to the golf club head 210.

Referring to FIGS. 21-24, examples of a golf club head 410 are shown. The golf club head 410 is an iron golf club head. The golf club head 410 includes features similar to those of the golf club head 210 and the golf club head 310, with like numbers referring to like features. For example, the golf club head 410 includes a body 420 having a heel portion 422, a toe portion 424, a topline portion 426, a sole portion 428, and a forward portion 430. Although not shown, the golf club head 410 also includes a rearward portion, opposite the forward portion 430. The heel portion 422 defines a hosel 432 of the golf club head 410.

Figure 21:
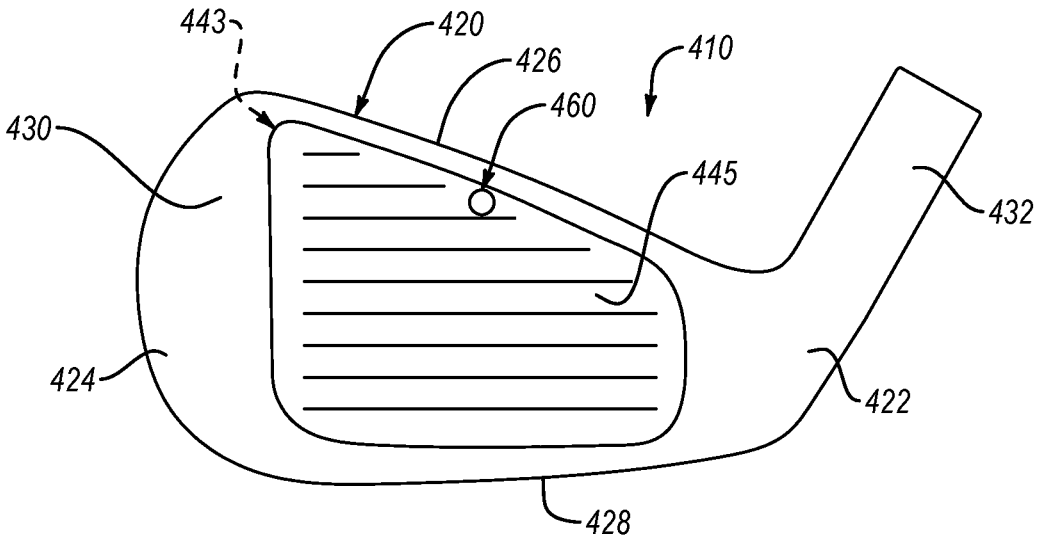
FIG. 21 is a schematic, front elevation view of a golf club head, according to one or more examples of the present disclosure.
Figure 22:
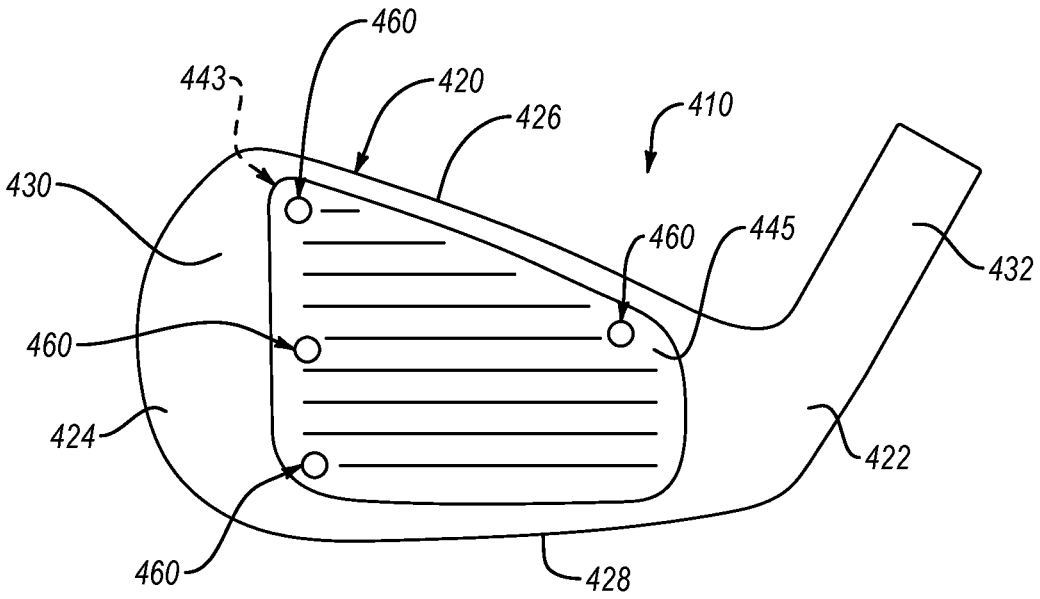
FIG. 22 is a schematic, front elevation view of a golf club head, according to one or more examples of the present disclosure.
Figure 23:
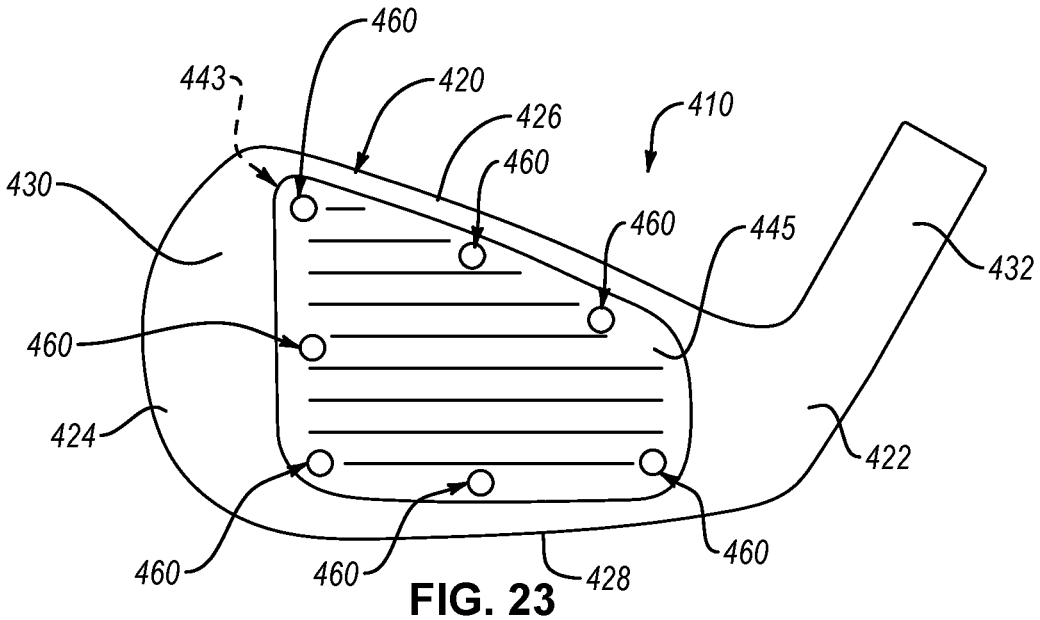
FIG. 23 is a schematic, front elevation view of a golf club head, according to one or more examples of the present disclosure.
Figure 24:
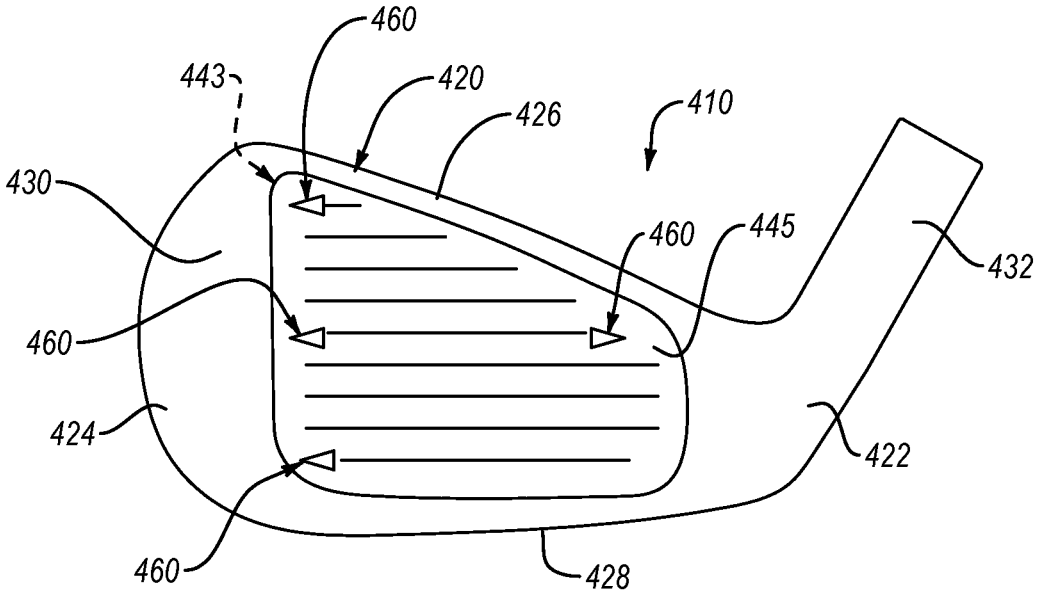
FIG. 24 is a schematic, front elevation view of a golf club head, according to one or more examples of the present disclosure.

The forward portion 430 defines a strike face 445 that can be co-formed with one or more other portions of the body 420 or formed separately from any other portion of the body 420. The forward portion 430 of the golf club head 410 also includes at least one tracking marker 460. The configuration and location of the tracking marker 460 on the forward portion 430 of the golf club head 410 can be similar to that of the tracking marker 260 of the golf club head 210. In the example of FIG. 21, the golf club head 410 includes a single tracking marker 460 that is located at an upper-central portion of the strike face 445. In the example of FIG. 22, the golf club head 410 includes multiple tracking markers 460 located at multiple spaced-apart locations around the strike face 445, such as at an upper-toe portion, a middle-toe portion, a lower-toe portion, and a middle-heel portion of the strike face 445. In the example of FIG. 23, the golf club head 410 also includes multiple tracking markers 460 located at multiple locations around the strike face 445. However, the quantity of tracking markers 460 of the example of FIG. 23 is greater than that of the tracking markers 460 of the example of FIG. 22. In contrast, as shown in FIG. 24, each one of multiple tracking markers 460 has a non-circular shape, such as a triangular shape.

In some examples, the strike face 445, whether co-formed with other portions of the body 420 or separately as a strike plate 443, is made of a metallic material, such as a steel alloy or a titanium alloy. Accordingly, the tracking markers 460 are embedded in the forward portion 430 in a manner similar to that shown in FIGS. 12 and 13. In other words, the strike face 445 can be defined by a metallic material and the tracking markers 460 are stickers or inserts inserted into recesses formed in the strike face 445. Of course, if the strike face 445 was defined by a polymeric layer of a strike plate 443 that includes an FRPM layer, the tracking markers 460 can be stickers interposed between the FRPM layer and the polymeric layer of the strike plate 443.

Figure 25:
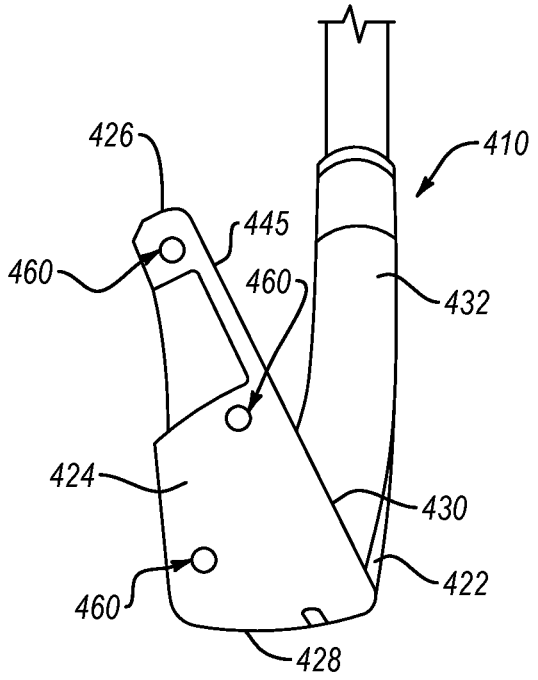
FIG. 25 is a schematic, side elevation view of a golf club head, according to one or more examples of the present disclosure.
Figure 26:
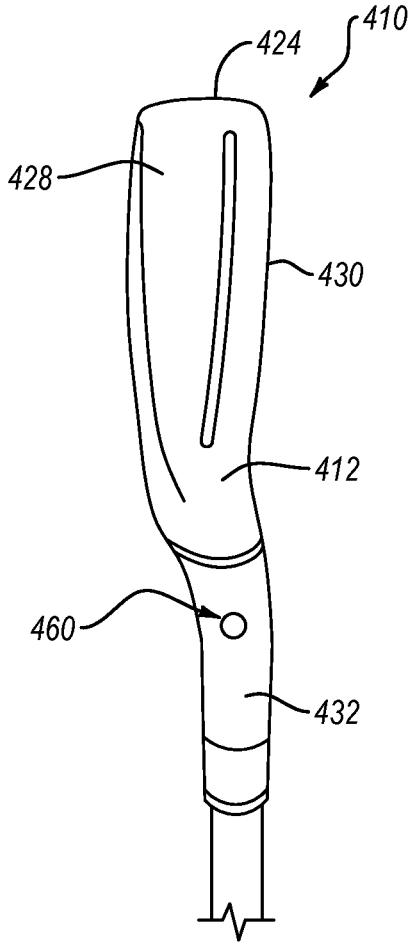
FIG. 26 is a schematic, bottom plan view of a golf club head, according to one or more examples of the present disclosure.

Although the examples of the golf club head 410 shown in FIGS. 21-24 have one or more tracking markers 460 at one or more locations around the strike face 445, in other examples, such as shown in FIGS. 25 and 26, instead of or in addition to tracking markers 460 at the strike face 445, the golf club head 410 includes one or more tracking markers 460 at portions of the golf club head 410 other than the strike face 445. In the example shown in FIG. 25, the golf club head 410 includes multiple tracking markers 460 at multiple locations around the toe portion 424 or on a toe side of the golf club head 410. More specifically, the golf club head 410 of FIG. 25 has three tracking markers 460 on the toe portion 424 (e.g., spaced apart in a crown-to-sole direction). In certain examples, such as shown in FIG. 26, the golf club head 410 has at least one tracking marker 460 at a location on the heel portion 422 or the hosel 432 of the golf club head 410. With one or more tracking markers 460 on the heel portion 422 or the hosel 432, a depth of the golf club head 410 can be more easily defined and identified by the launch monitor.

The tracking markers 460, at locations on the golf club head 410 other than the strike face 445, can be formed in a manner similar to the tracking markers 460 on the strike face 445 to be a permanent part of the golf club head 410. For example, the tracking markers 460 on the toe portion 424, the hosel 432, or other portions of the golf club head 410, the tracking markers 460 can be stickers or inserts or inserts inserted into recesses formed in the golf club head 410.

Referring to FIGS. 27-30, examples of a golf club head 510 are shown. The golf club head 510 is a putter golf club head. The golf club head 510 includes features similar to those of the golf club head 210, the golf club head 310, and the golf club head 410, with like numbers referring to like features. For example, the golf club head 510 includes a body 520 having a heel portion 522, a toe portion 524, a top portion 526, a sole portion 528, and a forward portion 530. Although not shown, the golf club head 510 also includes a rearward portion, opposite the forward portion 530. The heel portion 522 defines a hosel 532 of the golf club head 510.

Figure 27:
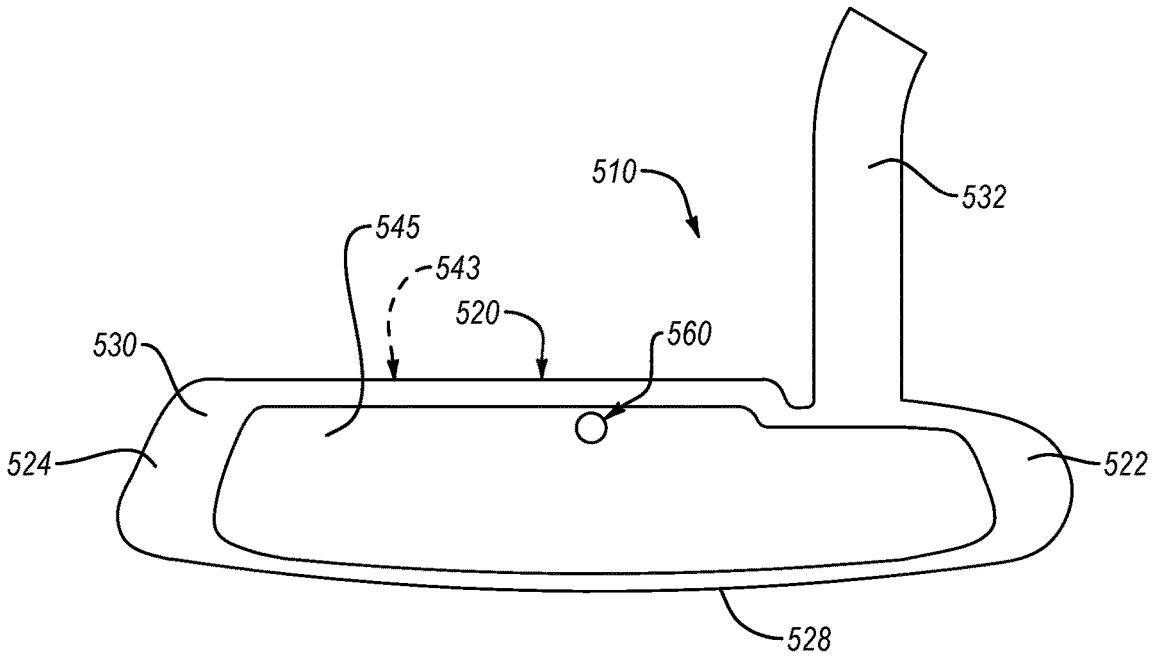
FIG. 27 is a schematic, front elevation view of a golf club head, according to one or more examples of the present disclosure.
Figure 28:
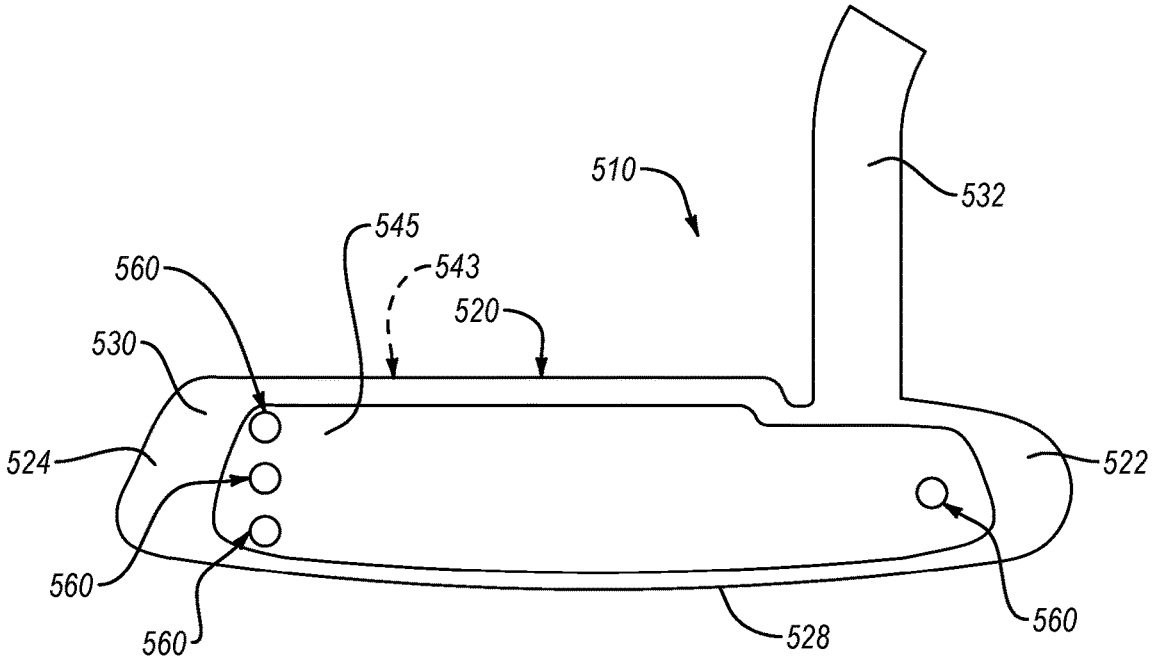
FIG. 28 is a schematic, front elevation view of a golf club head, according to one or more examples of the present disclosure.
Figure 29:
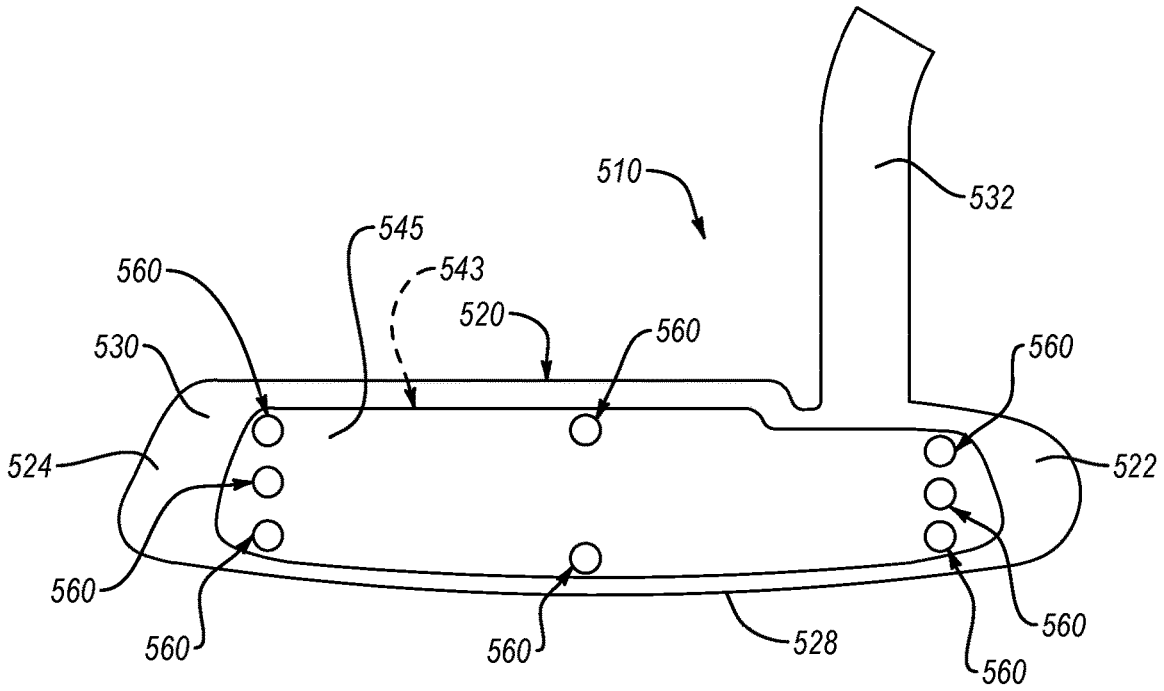
FIG. 29 is a schematic, front elevation view of a golf club head, according to one or more examples of the present disclosure.
Figure 30:
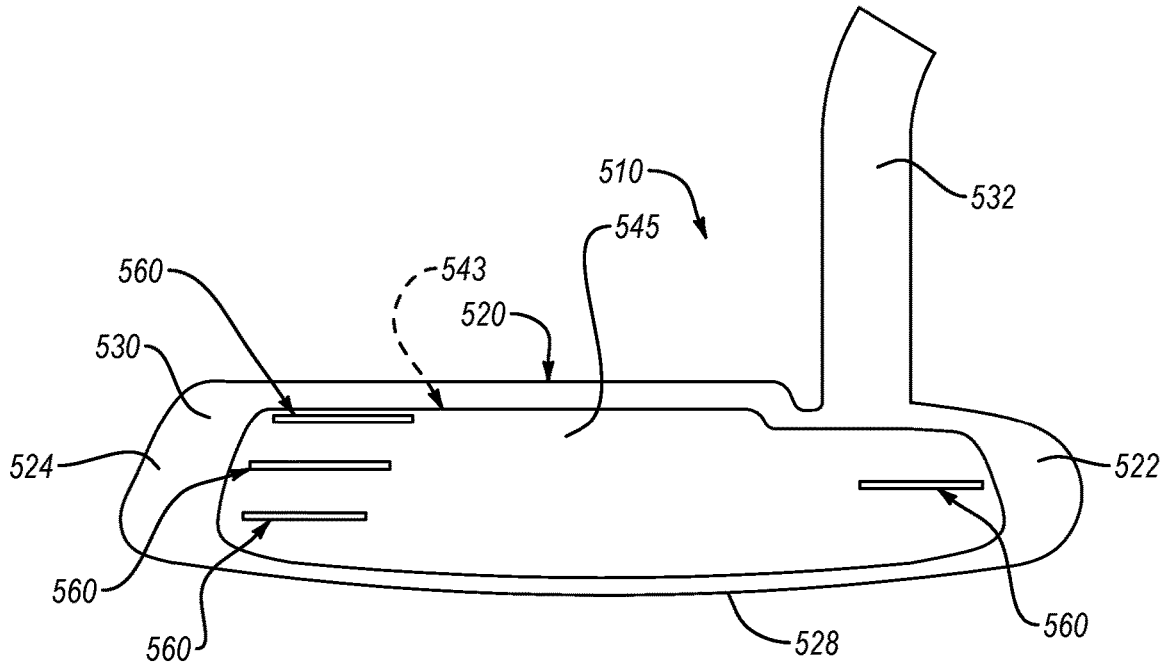
FIG. 30 is a schematic, front elevation view of a golf club head, according to one or more examples of the present disclosure.

The forward portion 530 defines a strike face 545 that can be co-formed with one or more other portions of the body 520 or formed separately from any other portion of the body 520. The forward portion 530 of the golf club head 510 also includes at least one tracking marker 560. The configuration and location of the tracking marker 560 on the forward portion 530 of the golf club head 510 can be similar to that of the tracking marker 260 of the golf club head 210. In the example of FIG. 27, the golf club head 510 includes a single tracking marker 560 that is located at an upper-central portion of the strike face 545. In the example of FIG. 28, the golf club head 510 includes multiple tracking markers 560 located at multiple spaced-apart locations around the strike face 545, such as at an upper-toe portion, a middle-toe portion, a lower-toe portion, and a middle-heel portion of the strike face 545. In the example of FIG. 29, the golf club head 510 also includes multiple tracking markers 560 located at multiple locations around the strike face 545. However, the quantity of tracking markers 560 of the example of FIG. 29 is greater than that of the tracking markers 560 of the example of FIG. 28. In contrast, as shown in FIG. 30, each one of multiple tracking markers 560 has a non-circular shape, such as an elongated shape.

In some examples, the strike face 545, whether co-formed with other portions of the body 520 or separately as a strike plate 543, is made of a metallic material, rubber, material, or a plastic material. In these examples, the tracking markers 560 are embedded in the forward portion 530 in a manner similar to that shown in FIGS. 12 and 13. In other words, the tracking markers 460 are stickers or inserts inserted into a recess formed in the strike face 545. Of course, if the strike face 545 was defined by a polymeric layer of a strike plate 543 that includes an FRPM layer, the tracking markers 560 can be stickers or inserts interposed between the FRPM layer and the polymeric layer of the strike plate 543. The tracking markers 560 can be located in any of various alternative or additional locations around the golf club head 510, other than the strike face 545, in a manner similar to that described above with regard to the golf club head 210 and the golf club head 410.

Although the fairway-metal golf club head, the iron golf club head, and the putter golf club head shown in the figures each includes tracking markers, it is recognized that in other examples the fairway-metal golf club head, the iron golf club head, and the putter golf club head can include dummy markers, in addition to the tracking markers, such as described above in association with the driver-type golf club head.

Although examples of a tracking marker interposed between a polymeric layer and an FRPM of a laminated or layered strike plate, it is recognized that in some examples, a laminated or layered strike plate can include layers made of different materials (such a two non-fibrous plastic materials, or one plastic material and one metallic material) and the tracking marker can be located between such layers.

In certain examples, a primer can be applied above and/or below the tracking marker to promote adhesion of the tracking marker to the overlying surface and/or the underlying surface, respectively. When the primer is applied above the tracking marker, the primer is at least partially transparent to enable a launch monitor to visibly detect the presence of the tracking marker.

Although the tracking marker has been described as having a retroreflective surface, in some examples, as used herein, a retroreflective surface can be any surface that contrasts with its surrounding surface. Accordingly, as used herein, in some examples, a retroreflective surface does not have to have a retroreflectivity greater than the surrounding surface as long as the retroreflective surface has some feature that distinctly contrasts with its surrounding surface such that a launch monitor is able to distinguish the tracking marker from its surroundings. For example, the tracking marker and corresponding launch monitor can be one of the examples disclosed in U.S. Pat. No. 10,902,612, issued Jan. 26, 2021.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some examples, can be defined to mean within +/−5% of a given value.

Additionally, examples in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification.

For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A golf club head, comprising:

a forward portion, comprising a strike face having an inner layer and an outer layer; and at least one tracking marker, configured to be tracked by a launch monitor and permanently embedded in the forward portion and interposed between the outer layer and the inner layer, wherein:

the at least one tracking marker comprises a retroreflective surface that is more retroreflective than the strike face and is detectable by the launch monitor through the outer layer, the outer layer comprises scorelines formed in the strike face and the at least one tracking marker is offset from any one of the scorelines in a direction parallel to the strike face, the strike face, between the scorelines, is textured, and a texture of the strike face adjacent to the at least one tracking marker is different than a texture of the strike face over the at least one tracking marker.

2. The golf club head according to claim 1, wherein the inner layer is made of a fiber reinforced polymeric material and the outer layer is made of a non-reinforced polymeric material.

3. The golf club head according to claim 1, wherein a thickness of the outer layer between the strike face and the at least one tracking marker is greater than a thickness of the outer layer between any one of the scorelines and the inner layer.

4. The golf club head according to claim 1, wherein each one of the texture of the strike face adjacent to the at least one tracking marker and the texture of the strike face over the at least one tracking marker comprises a sawtooth pattern.

5. The golf club head according to claim 1, wherein:

the inner layer is made of a metallic material; and the outer layer is made of a non-reinforced polymeric material.

6. The golf club head according to claim 5, wherein:

the forward portion further comprises a recess formed in the strike face;

the at least one tracking marker is seated in the recess; and the outer layer comprises a cover in the recess over the at least one tracking marker.

7. The golf club head according to claim 1, wherein the retroreflective surface of the at least one tracking marker retroreflects at least light having a wavelength greater than 700 nanometers.

8. The golf club head according to claim 1, wherein:

the at least one tracking marker comprises a sticker having an adhesive layer and a retroreflective layer; and the retroreflective layer comprising a pattern of retroreflective elements each made of an at least partially transparent material.

9. The golf club head according to claim 8, wherein the sticker further comprises a cover fixed to the retroreflective layer so that the retroreflective layer is interposed between the cover and the adhesive layer.

10. The golf club head according to claim 1, wherein the golf club head comprises a plurality of tracking markers, each located at a corresponding one of an upper-toe position, a middle-toe position, a lower-toe position, and a middle-heel position of the strike face.

11. The golf club head according to claim 1, wherein the golf club head further comprises a plurality of tracking markers permanently embedded in the forward portion at various locations relative to the strike face.

12. The golf club head according to claim 1, wherein:

the forward portion comprises a strike plate;

the strike plate comprises a plurality of composite prepreg plies, and a polymeric cover that defines the strike face and is adjoined to the plurality of composite prepreg plies; and the polymeric cover has a thickness between, and inclusive of, 0.1 mm and 3.0 mm.

13. The golf club head according to claim 12, wherein:

the polymeric cover comprises a plurality of surface features configured so that a mean roughness of the strike face is between, and inclusive of, 2.5 micrometers and 5 micrometers; and the thickness of the polymeric cover is between, and inclusive of, 0.2 mm and 1.2 mm.

14. The golf club head according to claim 13, wherein the plurality of surface features have a peak-to-trough height of between, and inclusive of, 20 micrometers and 30 micrometers.

15. A golf club head, comprising:

a forward portion, comprising an inner layer and an outer layer adjoining the inner layer, wherein the outer layer defines a strike face; and at least one tracking marker permanently interposed between the outer layer and the inner layer, wherein an entirety of the tracking marker is covered by the outer layer, wherein the at least one tracking marker comprises a retroreflective surface that is more retroreflective than the strike face, is configured to be tracked by a launch monitor, and is configured to retroreflect at least infrared light having a wavelength between, and inclusive, of 725 nanometers (nm) and 1,250 nm;

wherein the golf club head comprises at least three tracking markers;

the at least one tracking marker comprises a sticker having an adhesive layer and a retroreflective layer; and the retroreflective layer comprising a pattern of retroreflective elements.

16. The golf club head according to claim 15, wherein the golf club head comprises four tracking markers permanently interposed between the outer layer and the inner layer of the forward portion.

17. The golf club head according to claim 15, wherein the sticker further comprises a cover fixed to the retroreflective layer so that the retroreflective layer is interposed between the cover and the adhesive layer.

18. The golf club head according to claim 15, wherein:

the golf club head has a volume of 390-600 cubic centimeters, and a club head mass of 185-210 grams;

the strike face is non-planar and has a bulge and a roll;

a maximum distance from a leading edge to a trailing edge of the golf club head is 112-127 mm;

the golf club head has a center of gravity (CG) located a Z-up value measured vertically from the center of gravity to a ground plane, and the Z-up value is 22-30 mm;

the CG is located a delta-1 dimension horizontally from a shaft plane that is 13-36 mm; and the golf club head has a Izz moment of inertia about a vertical axis CG z-axis passing through the CG, a Ixx moment of inertia about a horizontal axis CG x-axis passing through the CG, and a summation of Ixx and Izz is greater than 780 kg-mm$^2$.

19. The golf club head according to claim 18, wherein the outer layer has a mean roughness of the strike face is between, and inclusive of, 2.5 micrometers and 5 micrometers.

20. The golf club head according to claim 18, wherein at least a portion of the outer layer is textured.

21. The golf club head according to claim 18, wherein a plurality of scorelines are formed in the outer layer, and the summation of Ixx and Izz is greater than 825 kg-mm$^2$.

22. The golf club head according to claim 21, wherein the plurality of scorelines do not overlap the at least one tracking marker.

23. The golf club head according to claim 21, further including a hosel having a flight control technology (FCT) system adjustably joining the hosel and a shaft to control a position of the golf club head relative to the shaft, wherein:

the inner layer is made of a metallic material;

the outer layer is made of a polymeric material; and the summation of Ixx and Izz is greater than 875 kg-mm$^2$.

24. The golf club head according to claim 21, further including a hosel having a flight control technology (FCT) system adjustably joining the hosel and a shaft to control a position of the golf club head relative to the shaft, wherein:

the forward portion further comprises a recess formed in the strike face;

the at least one tracking marker is seated in the recess; and the outer layer comprises a cover over the at least one tracking marker.

25. The golf club head according to claim 21, further including a hosel having a flight control technology (FCT) system adjustably joining the hosel and a shaft to control a position of the golf club head relative to the shaft, wherein the inner layer is made of a fiber reinforced polymeric material and the outer layer is made of a non-reinforced polymeric material.

26. The golf club head according to claim 25, wherein:

the forward portion comprises a strike plate;

the strike plate comprises a plurality of composite prepreg plies, and a polymeric cover that defines the strike face and covers the plurality of composite prepreg plies; and the polymeric cover has a thickness between, and inclusive of, 0.1 mm and 3.0 mm.

27. A golf club head, comprising:

a forward portion, comprising a strike face having a strike plate; and at least one tracking marker, configured to be tracked by a launch monitor and permanently embedded in the forward portion, wherein:

the at least one tracking marker comprises a retroreflective surface that is more retroreflective than the strike face, the strike plate comprises a plurality of composite prepreg plies and a polymeric cover having a thickness between, and inclusive of, 0.1 mm and 3.0 mm, the at least one tracking marker comprises a sticker having an adhesive layer and a retroreflective layer, and the retroreflective layer comprising a pattern of retroreflective elements.

28. The golf club head according to claim 27, wherein a plurality of scorelines are formed in the polymeric cover, and the strike face is non-planar and has a bulge and a roll.

29. The golf club head according to claim 28, wherein the plurality of scorelines do not overlap the at least one tracking marker, and the golf club head has a volume of 390-600 cubic centimeters, and a club head mass of 185-210 grams.

30. The golf club head according to claim 29, wherein a first thickness of the polymeric cover over the at least one tracking marker is greater than a second thickness of the polymeric cover between a deepest point of a scoreline and the composite prepreg plies, and a maximum distance from a leading edge to a trailing edge of the golf club head is 112-127 mm.

31. The golf club head according to claim 28, wherein at least a portion of the polymeric cover is textured, and the golf club head has a volume of 390-600 cubic centimeters, and a club head mass of 185-210 grams.

32. The golf club head according to claim 28, wherein the retroreflective surface of the at least one tracking marker retroreflects at least light having a wavelength greater than 700 nanometers, the golf club head has a volume of 390-600 cubic centimeters, and a club head mass of 185-210 grams, a maximum distance from a leading edge to a trailing edge of the golf club head is 112-127 mm, the golf club head has a center of gravity (CG) located a Z-up value measured vertically from the center of gravity to a ground plane, and the Z-up value is 22-30 mm.

33. The golf club head according to claim 32, wherein the retroreflective surface of the at least one tracking marker retroreflects at least light having a wavelength up to 1250 nanometers, the CG is located a delta-1 dimension horizontally from a shaft plane that is 13-36 mm, the golf club head has a Izz moment of inertia about a vertical axis CG z-axis passing through the CG, a Ixx moment of inertia about a horizontal axis CG x-axis passing through the CG, and a summation of Ixx and Izz is greater than 780 kg-mm$^2$.

34. The golf club head according to claim 33, wherein the golf club head comprises a plurality of tracking markers, Ixx is greater than 300 kg-mm$^2$, Izz is greater than 450 kg-mm$^2$, and the summation of Ixx and Izz is greater than 875 kg-mm$^2$.

35. The golf club head according to claim 34, wherein Ixx is greater than 350 kg-mm$^2$, the summation of Ixx and Izz is greater than 975 kg-mm$^2$, Ixx is at least 65% of Izz, and further including a hosel having a flight control technology (FCT) system adjustably joining the hosel and a shaft to control a position of the golf club head relative to the shaft.

36. The golf club head according to claim 27, wherein:

the forward portion further comprises a recess formed in the strike face;

the at least one tracking marker is seated in the recess; and the polymeric cover extends over the at least one tracking marker.

37. The golf club head according to claim 27, wherein the sticker further comprises a cover fixed to the retroreflective layer so that air gaps are defined between the cover and the retroreflective elements, and so that the retroreflective layer is interposed between the cover and the adhesive layer.

38. A golf club head, comprising:

a forward portion, comprising a strike face having a metallic inner layer and a non-reinforced polymeric outer layer; and at least one tracking marker, configured to be tracked by a launch monitor and permanently embedded in the forward portion and interposed between the outer layer and the inner layer, wherein:

the at least one tracking marker comprises a retroreflective surface that is more retroreflective than the strike face and is detectable by the launch monitor through the outer layer, the forward portion comprises a recess formed in the metallic inner layer and the at least one tracking marker is seated in the recess, and the outer layer extends over the at least one tracking marker.

39. The golf club head according to claim 38, wherein the retroreflective surface of the at least one tracking marker retroreflects at least light having a wavelength of 725-1250 nanometers.

40. The golf club head according to claim 39, wherein a plurality of scorelines are formed in the outer layer.

41. The golf club head according to claim 40, wherein the plurality of scorelines do not overlap the at least one tracking marker.

42. The golf club head according to claim 40, wherein a first thickness of the outer layer over the at least one tracking marker is greater than a second thickness of the outer layer between a deepest point of a scoreline and the inner layer.

43. The golf club head according to claim 39, wherein at least a portion of the outer layer is textured.

44. The golf club head according to claim 39, wherein the golf club head has at least two tracking markers, a volume of 390-600 cubic centimeters, a club head mass of 185-210 grams, a maximum distance from a leading edge to a trailing edge of the golf club head is 112-127 mm, the golf club head has a center of gravity (CG) located a Z-up value measured vertically from the center of gravity to a ground plane, the Z-up value is 22-30 mm, and the golf club head further includes a hosel having a flight control technology (FCT) system adjustably joining the hosel and a shaft to control a position of the golf club head relative to the shaft.

45. The golf club head according to claim 44, wherein the CG is located a delta-1 dimension horizontally from a shaft plane that is 13-36 mm, the golf club head has a Izz moment of inertia about a vertical axis CG z-axis passing through the CG, a Ixx moment of inertia about a horizontal axis CG x-axis passing through the CG, and a summation of Ixx and Izz is greater than 825 kg-mm$^2$.

46. The golf club head according to claim 45, wherein Izz is greater than 510 kg-mm$^2$, and the summation of Ixx and Izz is greater than 875 kg-mm$^2$.

47. The golf club head according to claim 46, wherein Ixx is greater than 350 kg-mm$^2$, and the summation of Ixx and Izz is greater than 975 kg-mm$^2$.

48. The golf club head according to claim 38, wherein:

the at least one tracking marker comprises a sticker having an adhesive layer and a retroreflective layer; and the retroreflective layer comprises a pattern of retroreflective elements.

49. The golf club head according to claim 48, wherein the sticker further comprises a cover fixed to the retroreflective layer so that air gaps are defined between the cover and the retroreflective elements, and so that the retroreflective layer is interposed between the cover and the adhesive layer.

50. The golf club head according to claim 38, wherein the at least one tracking marker is configured to retroreflect at least visible light having a wavelength between, and inclusive, of 400 nanometers (nm) and 700 nm.

51. The golf club head according to claim 38, wherein the outer layer has a mean roughness between, and inclusive of, 2.5 micrometers and 5 micrometers.

52. A golf club head, comprising:

a forward portion, comprising a strike face; and at least one tracking marker, configured to be tracked by a launch monitor and permanently embedded in the forward portion, wherein:

the at least one tracking marker comprises a retroreflective surface that is more retroreflective than the strike face, the at least one tracking marker comprises a sticker having an adhesive layer and a retroreflective layer, and the retroreflective layer comprises a pattern of retroreflective elements each made of an at least partially transparent material.

53. The golf club head according to claim 52, wherein the golf club head comprises at least three tracking markers.

54. The golf club head according to claim 53, wherein the retroreflective surface of the at least one tracking marker retroreflects at least light having a wavelength greater than 700 nanometers.

55. The golf club head according to claim 54, wherein at least a portion of the strike face is textured.

56. The golf club head according to claim 54, wherein the retroreflective surface of the at least one tracking marker retroreflects at least light having a wavelength up to 1250 nanometers.

57. The golf club head according to claim 56, wherein the forward portion further comprises a recess formed in the strike face, and the at least one tracking marker is seated in the recess.

58. The golf club head according to claim 57, wherein the sticker further comprises a cover fixed to the retroreflective layer so that the retroreflective layer is interposed between the cover and the adhesive layer.

59. The golf club head according to claim 57, wherein:

the golf club head has a volume of 390-600 cubic centimeters, and a club head mass of 185-210 grams;

the strike face is non-planar and has a bulge and a roll;

a maximum distance from a leading edge to a trailing edge of the golf club head is 112-127 mm;

the golf club head has a center of gravity (CG) located a Z-up value measured vertically from the center of gravity to a ground plane, and the Z-up value is 22-30 mm;

the CG is located a delta-1 dimension horizontally from a shaft plane that is 13-36 mm;

the golf club head has a Izz moment of inertia about a vertical axis CG z-axis passing through the CG, a Ixx moment of inertia about a horizontal axis CG x-axis passing through the CG, and a summation of Ixx and Izz is greater than 780 kg-mm$^2$; and the golf club head further includes a hosel having a flight control technology (FCT) system adjustably joining the hosel and a shaft to control a position of the golf club head relative to the shaft.

60. The golf club head according to claim 59, wherein the strike face is made of a non-metallic material.

61. The golf club head according to claim 59, wherein the strike face is made of a metallic material.

62. The golf club head according to claim 61, wherein Izz is greater than 450 kg-mm$^2$, and the summation of Ixx and Izz is greater than 825 kg-mm$^2$.

63. The golf club head according to claim 62, wherein Izz is greater than 510 kg-mm$^2$, and the summation of Ixx and Izz is greater than 925 kg-mm$^2$.

64. The golf club head according to claim 63, wherein Ixx is greater than 350 kg-mm$^2$, the summation of Ixx and Izz is greater than 975 kg-mm$^2$, and Ixx is at least 65% of Izz.

65. The golf club head according to claim 54, wherein the at least one tracking marker is configured to retroreflect at least visible light having a wavelength between, and inclusive, of 400 nanometers (nm) and 700 nm.

* * * * *